US008903270B2

(12) United States Patent
Sakata et al.

(10) Patent No.: US 8,903,270 B2
(45) Date of Patent: Dec. 2, 2014

(54) DEVELOPING DEVICE, IMAGE FORMING APPARATUS, AND PROCESS CARTRIDGE

(75) Inventors: Koichi Sakata, Shizuoka (JP); Shigenori Yaguchi, Shizuoka (JP); Toyoshi Sawada, Kanagawa (JP); Hitoshi Iwatsuki, Shizuoka (JP); Hiroyuki Kishida, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 100 days.

(21) Appl. No.: 13/412,195

(22) Filed: Mar. 5, 2012

(65) Prior Publication Data

US 2012/0230725 A1 Sep. 13, 2012

(30) Foreign Application Priority Data

Mar. 11, 2011 (JP) ..... 2011-054656
Feb. 8, 2012 (JP) ..... 2012-025119

(51) Int. Cl.
*G03G 15/09* (2006.01)

(52) U.S. Cl.
CPC ..... *G03G 15/0928* (2013.01)
USPC ..... 399/111; 399/272; 399/281; 430/111.1; 430/122.1; 430/122.4

(58) Field of Classification Search
USPC ..... 399/111, 119, 267, 276, 277, 281, 282; 430/111.35, 111.4, 114.41, 122.2, 430/122.4
See application file for complete search history.

(56) References Cited

U.S. PATENT DOCUMENTS 6,124,067 A * 9/2000 Mikuriya et al. ..... 430/100
6,312,862 B1 * 11/2001 Okado et al. ..... 430/110.1
6,589,703 B2 * 7/2003 Stelter et al. ..... 430/122.3
6,725,007 B2 * 4/2004 Igarashi ..... 399/267
7,381,513 B2 6/2008 Suzuki et al.
7,474,867 B2 * 1/2009 Ozeki et al. ..... 399/270
7,527,908 B2 5/2009 Iwatsuki et al.
7,670,744 B2 * 3/2010 Yuasa et al. ..... 430/137.14
8,026,032 B2 9/2011 Iwatsuki et al.

(Continued)

FOREIGN PATENT DOCUMENTS

JP 42-1627 1/1967
JP 41-20153 11/1967

(Continued)

OTHER PUBLICATIONS

Nagayama, JP 2010055037,Machine Translation.*

(Continued)

*Primary Examiner* — Francis Gray
(74) *Attorney, Agent, or Firm* — Oblon, Spivak, McClelland, Maier & Neustadt, L.L.P.

(57) ABSTRACT

A developing device including a developer bearing member containing a magnetic field generator having multiple magnetic poles and a developer containing chamber is provided. The developer containing chamber contains a two-component developer comprising magnetic carrier particles having a saturated magnetization of 58 to 70 emu/g in a magnetic field of 1KOe and toner particles, and has a divider to define an upper supply chamber and a lower collection chamber. The supply chamber includes a supply conveyer to supply the two-component developer to the developer bearing member at an upstream side from the developing area. The collection chamber includes a collection conveyer to collect the two-component developer from the developer bearing member at a downstream side from the developing area. The multiple magnetic poles includes three developer bearing poles capable of bearing the developer on its surface.

17 Claims, 6 Drawing Sheets

(56) References Cited

U.S. PATENT DOCUMENTS

| | | | | |
|---|---|---|---|---|
| 8,045,892 | B2 | 10/2011 | Sakata et al. | |
| 2004/0179861 | A1* | 9/2004 | Mochizuki et al. | 399/159 |
| 2007/0172748 | A1* | 7/2007 | Inoue et al. | 430/45.56 |
| 2008/0152393 | A1 | 6/2008 | Nagayama et al. | |
| 2008/0213684 | A1 | 9/2008 | Nagayama et al. | |
| 2009/0103943 | A1 | 4/2009 | Sakata | |
| 2010/0061759 | A1 | 3/2010 | Moriya et al. | |
| 2010/0202805 | A1* | 8/2010 | Miyoshi et al. | 399/277 |
| 2010/0239975 | A1 | 9/2010 | Yamaguchi et al. | |
| 2011/0065037 | A1 | 3/2011 | Iwatsuki et al. | |
| 2011/0086307 | A1 | 4/2011 | Nakajima et al. | |
| 2011/0171573 | A1 | 7/2011 | Sakata et al. | |
| 2011/0217649 | A1 | 9/2011 | Masuda et al. | |
| 2011/0229817 | A1 | 9/2011 | Yamada et al. | |
| 2012/0009514 | A1 | 1/2012 | Nagayama et al. | |
| 2012/0009518 | A1 | 1/2012 | Nagayama et al. | |

FOREIGN PATENT DOCUMENTS

| | | | |
|---|---|---|---|
| JP | 43-27596 | | 11/1968 |
| JP | 44-6397 | | 3/1969 |
| JP | 45-26478 | | 9/1970 |
| JP | 55-42752 | | 11/1980 |
| JP | 59-7385 | | 2/1984 |
| JP | 09160388 | A * | 6/1997 |
| JP | 11-184249 | | 7/1999 |
| JP | 2007-193289 | | 8/2007 |
| JP | 2008-203814 | | 9/2008 |
| JP | 2008-203816 | | 9/2008 |
| JP | 2008-287155 | | 11/2008 |
| JP | 2008-292972 | | 12/2008 |
| JP | 2009-9022 | | 1/2009 |
| JP | 2009-47891 | | 3/2009 |
| JP | 2009-63991 | | 3/2009 |
| JP | 2009-98459 | | 5/2009 |
| JP | 2010-55037 | | 3/2010 |
| JP | 2010055037 | A * | 3/2010 |
| JP | 2010-204639 | | 9/2010 |
| JP | 2010-217328 | | 9/2010 |

OTHER PUBLICATIONS

JP-09160388 A machine translation.*

Nagayama, image forming method, JP 2010055037, Mar. 2010, Machine Translation.*

* cited by examiner

DEVELOPING DEVICE, IMAGE FORMING APPARATUS, AND PROCESS CARTRIDGE

CROSS-REFERENCE TO RELATED APPLICATIONS

This patent application is based on and claims priority pursuant to 35 U.S.C. §119 to Japanese Patent Application Nos. 2011-054656 and 2012-025119, filed on Mar. 11, 2011 and Feb. 8, 2012, respectively, in the Japanese Patent Office, the entire disclosure of each of which is hereby incorporated herein by reference.

BACKGROUND

1. Technical Field

The present disclosure relates to a developing device for use in image forming apparatuses such as copiers, facsimile machines, and printers, and an image forming apparatus and a process cartridge each using the developing device.

2. Description of the Background

In electrophotography, two-component developing methods are widely employed that use a two-component developer comprised of toner particles and magnetic carrier particles. Two-component developing methods have an advantage over one-component developing methods in terms of durability and image quality. A typical two-component developing device includes a developer bearing member containing a magnetic field generator having multiple magnetic poles (hereinafter "developing sleeve"). The developing sleeve is configured to bear a developer on its surface and to convey the developer as it rotates. Japanese Patent Application Publication No. 11-184249 describes a developing device having a developing sleeve containing a magnetic field generator having five magnetic poles. The five magnetic poles include a developer-supplying pole, a pre-developing developer-conveying pole, a developing pole, a developer-separating pole, and a post-developing developer-conveying pole. The developer-supplying pole contributes to supply of the developer to the surface of the developing sleeve. The pre-developing developer-conveying pole contributes to conveyance of the supplied developer to the developing area where the developing sleeve faces a latent image bearing member. The developing pole contributes to development of a latent image in the developing area. The developer-separating pole contributes to separation of the developer from the developing sleeve after the developer has passed through the developing area. The post-developing developer-conveying pole is disposed between the developing pole and the developer-separating pole, and contributes to conveyance of the developer to the position where the developer separates from the developing sleeve after the developer has passed through the developing area. A developer regulator is further disposed facing the developing sleeve between the developer-supplying pole and the pre-developing developer-conveying pole. The developer regulator is adapted to regulate the amount of developer to be conveyed to the developing area. Another two-component developing device has been also proposed further including a developer regulating pole disposed facing the developer regulator and no post-developing developer-conveying pole.

In accordance with recent demand for compact image forming apparatus, the developing device is required to be more compact, and therefore the developing sleeve is also required to have a smaller diameter. However, it may be difficult for a small-diameter developing sleeve to reliably perform the processes of supplying, conveying, and separating the developer and developing latent images. This is because it is difficult for the small-diameter developing sleeve to contain at least five magnets which can generate a magnetic field having a strength enough for performing each process. Generally, the greater the magnetic force of a magnet, the greater the size of the magnet.

Japanese Patent Application Publication No. 2010-204639 describes a more compact developing device having only three magnetic poles.

Such a compact developing device is likely to have a configuration such that the developer is supplied from an upper side of the developing sleeve. The developer supplied from the upper side of the developing sleeve is pressed against the developing sleeve due to its weight. The pressure from the developer is different between an upstream side and a downstream side with respect to a supply screw that supplies the developer to the developing sleeve. At the upstream side, the developer is pressed against the developing sleeve with a higher pressure and therefore the developer forms dense ears on the developing sleeve. By contrast, at the downstream side, the developer is pressed against the developing sleeve with a lower pressure and therefore the developer forms sparse ears on the developing sleeve. As a result, the resulting solid and halftone images may be lacking in uniformity between the upper side and the lower side with respect to the supply screw.

SUMMARY

Exemplary aspects according to embodiments of the present invention are put forward in view of the above-described circumstances, and provide a compact developing device capable of producing high-quality images having a uniform image density for an extended period of time.

In one exemplary embodiment, a developing device includes a cylindrical and rotatable developer bearing member and a developer containing chamber.

The cylindrical and rotatable developer bearing member contains a magnetic field generator having multiple magnetic poles, and is disposed facing an electrostatic latent image bearing member to form a developing area therebetween.

The developer containing chamber contains a two-component developer comprising magnetic carrier particles having a saturated magnetization of 58 to 70 emu/g in a magnetic field of 1KOe and toner particles. The developer containing chamber has a divider to define an upper supply chamber and a lower collection chamber.

The supply chamber is disposed on a substantially upper side of the developer bearing member. The supply chamber includes a supply conveyer to supply the two-component developer to the developer bearing member at an upstream side from the developing area while conveying the two-component developer in an axial direction of the developer bearing member within the supply chamber.

The collection chamber is disposed on a substantially lower side of the developer bearing member. The collection chamber includes a collection conveyer to collect the two-component developer from the developer bearing member at a downstream side from the developing area while conveying the two-component developer in the axial direction of the developer bearing member within the collection chamber.

The multiple magnetic poles includes three developer bearing poles capable of bearing the developer on its surface. The three developer bearing poles consists of a developing pole, a pre-developing pole, and a post-developing pole. The developing pole generates a magnetic field in the developing area. The pre-developing pole generates a magnetic field that conveys the developer supplied from the supply chamber to the developing area. The post-developing pole generates a magnetic field that separates the developer from the developer bearing member at a downstream side from the developing area and an upstream side from the developing pole.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
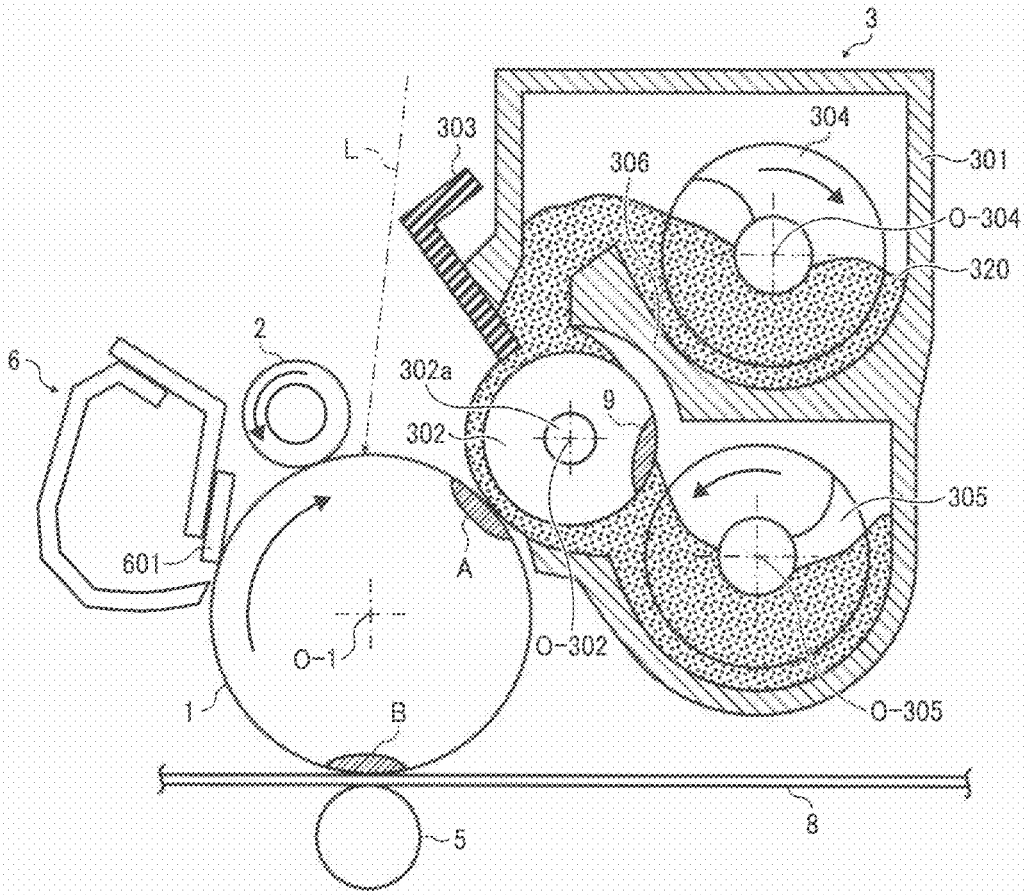
FIG. 1 is a schematic view illustrating an image forming apparatus according to an embodiment.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

For the sake of simplicity, the same reference number will be given to identical constituent elements such as parts and materials having the same functions and redundant descriptions thereof omitted unless otherwise stated.

FIG. 1 is a schematic view illustrating an image forming apparatus according to an embodiment. The image forming apparatus includes a photoreceptor 1 and a developing device 3. The photoreceptor 1 rotates clockwise in FIG. 1. A charger 2 is disposed on an upper side of the photoreceptor 1. In this embodiment, the charger 2 employs a rotating body that rotates at the same speed as the photoreceptor 1. In another embodiment, the charger 2 may employ a corona charger. The charger 2 uniformly charges a surface of the photoreceptor 1 in darkness. The charged surface of the photoreceptor 1 is exposed to light L emitted from a writing unit. Thus, an electrostatic latent image is formed on the photoreceptor 1. The electrostatic latent image is conveyed downstream as the photoreceptor 1 rotates so as to face the developing device 3. The developing device 3 is disposed on a right side of the photoreceptor 1 in FIG. 1.

The developing device 3 includes a casing 301, a supply chamber conveyer 304, a collection chamber conveyer 305, and a developing roller 302. The supply chamber conveyer 304 and collection chamber conveyer 305 are both adapted to agitate and convey a developer 320. The developing roller 302 is disposed facing the photoreceptor 1 while forming a developing area A therebetween. The casing 301 has an opening that exposes the developing roller 302 to the photoreceptor 1.

The developing roller 302 is adapted to convey the developer 320 from inside of the casing 301 to the developing area A. In the developing area A, toner particles contained in the developer 320 are adhered to the electrostatic latent image on the photoreceptor 1. Thus, the electrostatic latent image is developed into a toner image. The toner image is conveyed downstream as the photoreceptor 1 rotates so as to face a transfer device 5. The transfer device 5 is disposed on a lower side of the photoreceptor 1 in FIG. 1. In this embodiment, the transfer device 5 employs a rotating body. In another embodiment, the transfer device 5 may employ a corona charger. The transfer device 5 is disposed facing the photoreceptor 1 while forming a transfer area B therebetween.

In the transfer area B, the toner image is transferred from the photoreceptor 1 onto a transfer paper 8. In another embodiment, in the transfer area B, the toner image may be transferred from the photoreceptor 1 onto an intermediate transfer member (e.g., an intermediate transfer belt).

The surface of the photoreceptor 1 from which the toner image has been transferred is conveyed downstream as the photoreceptor 1 rotates so as to face a cleaner 6. The cleaner 6 is disposed on a substantially left side of the photoreceptor 1 in FIG. 1. In the cleaner 6, a cleaning blade 601 removes residual toner particles remaining on the photoreceptor 1 without being transferred onto the transfer paper 8. The surface of the photoreceptor 1 from which residual toner particles have been removed by the cleaner 6 is uniformly charged by the charger 2 again. These image forming processes are repeated.

As described above, the developing device 3 includes the casing 301, the developing roller 302, the supply chamber conveyer 304, and the collection chamber conveyer 305, and further includes a developer regulator 303. The supply chamber conveyer 304 and collection chamber conveyer 305 are both adapted to agitate and convey the developer 320 so that the developer 320 is circulated within the casing 301. In this embodiment, each of the supply chamber conveyer 304 and collection chamber conveyer 305 employs a screw having a spiral blade having an outer diameter of 16 mm or less.

Figure 2:
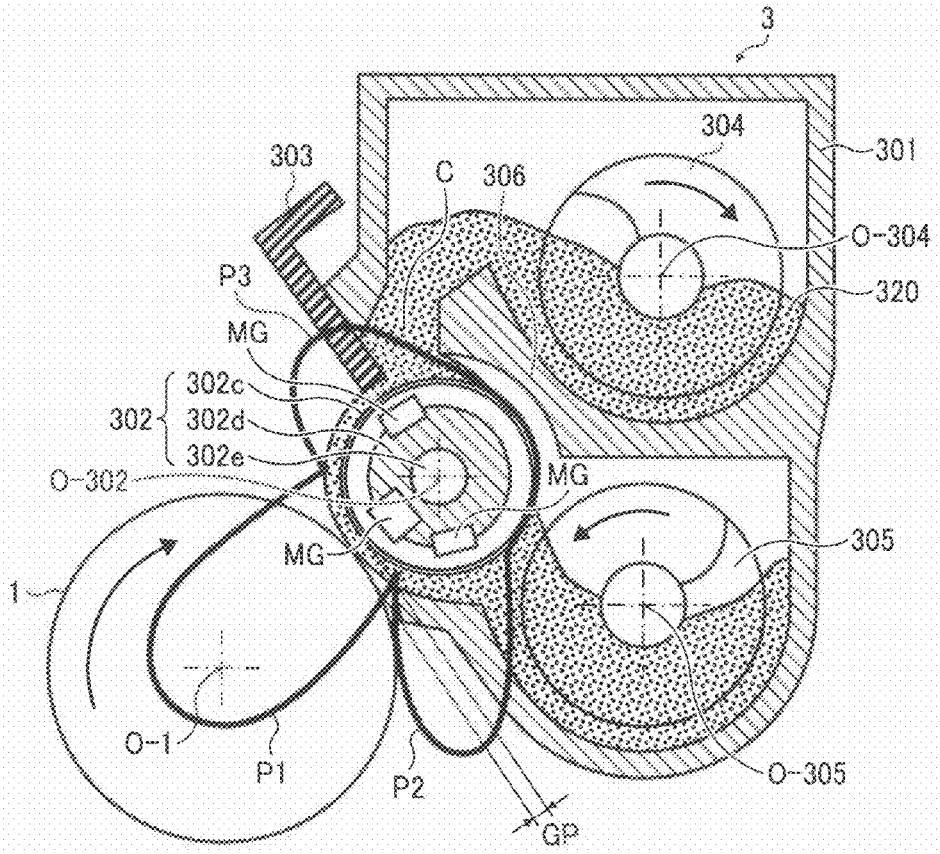
FIG. 2 is a magnified view of the developing device included in the image forming apparatus illustrated in FIG. 1.

FIG. 2 is a magnified view of the developing device 3. Referring to FIG. 2, the developing roller 302 includes a cylindrical sleeve 302*c*, a magnet roller 302*d*, and a rotary shaft 302*e*. Multiple magnets MG are circumferentially disposed on the magnet roller 302*d*. The sleeve 302*c* and the rotary shaft 302*e* are adapted to integrally rotate around the magnet roller 302*d*.

In this embodiment, the sleeve 302*c* is comprised of a nonmagnetic metal such as aluminum. The magnet roller 302*d* is static so that each of the magnets MG keeps facing a predetermined direction. In this embodiment, the magnet roller 302*d* is fixed to the casing 301. The developer 320 is attracted to the sleeve 302*c* by the magnets MG and is conveyed along with rotation of the sleeve 302*c*.

Figure 3:
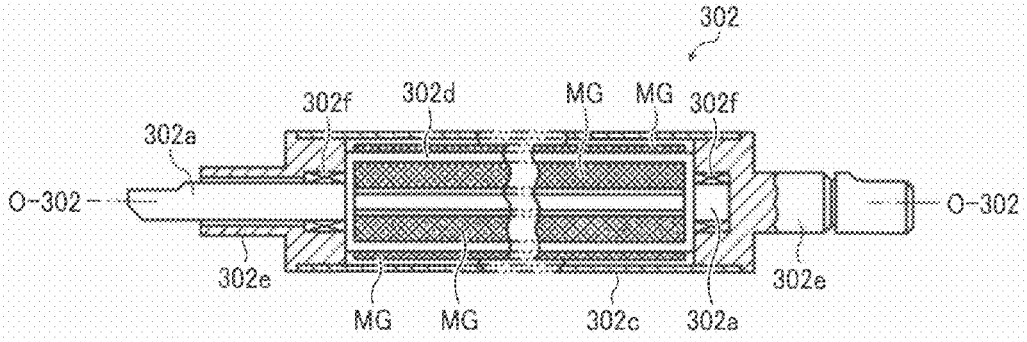
FIG. 3 is a cross-sectional view of the developing roller in an axial direction included in the developing device illustrated in FIG. 2.

FIG. 3 is a cross-sectional view of the developing roller 302 in an axial direction. The developing roller 302 includes a static shaft 302*a* fixed to the immovable casing 301, the magnet roller 302*d* integrated with the static shaft 302*a*, the sleeve 302*c* covering the magnet roller 302*d* while forming a gap therebetween, and the rotary shaft 302*e* integrated with the sleeve 302*c*. The rotary shaft 302*e* is rotatable relative to the static shaft 302*a* via bearings 302*f*. The rotary shaft 302*e* is driven to rotate upon transmission of power from a driver.

As illustrated in FIG. 3, the magnets MG are circumferentially disposed on the magnet roller 302*d* at a predetermined interval. The sleeve 302*c* is adapted to rotate around the magnets MG. Each of the magnets MG forms a magnetic field to form or regulate ears of the developer 320 on the circumferential surface of the sleeve 302*c*. In particular, magnetic carrier particles in the developer 320 aggregate along normal magnetic field lines generated from the magnets MG. Thus, a magnetic brush is formed.

Figure 4:
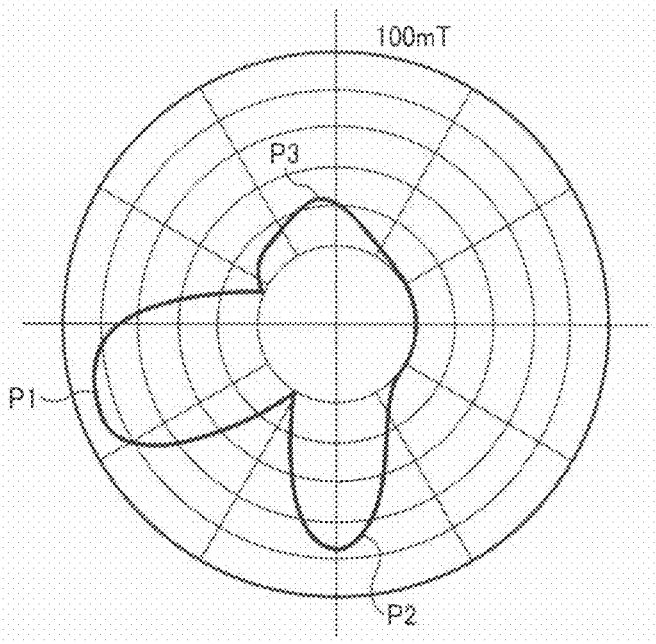
FIG. 4 illustrates an example of a magnetic flux density distribution of the magnet roller included in the developing device illustrated in FIG. 2.

In the present embodiment illustrated in FIG. 2, the magnet roller 302*d* has three magnets MG. Thus, the magnet roller 302*d* generates a magnetic force distribution such that three magnetic poles exist. The first magnetic pole P1 (developing pole) exists on a line connecting the center O-302 of the developing roller 302 and the center O-1 of the photoreceptor 1. The first magnetic pole P1 exists over the developing area A. The second magnetic pole P2 (casing facing pole) and the third magnetic pole P3 (developer regulator facing pole) are disposed in this order relative to the direction of rotation of the developing roller 302. In the present embodiment, the first, second, and, third magnetic poles P1, P2, and P3 employ north, south, and south poles, respectively. In another embodiment, each of the magnetic poles may have the opposite polarity to the present embodiment. The pole P1 (developing pole) is facing the photoreceptor 1. The pole P2 is facing the casing 301 and the pole P3 is facing the developer regulator 303. FIG. 4 illustrates an example of a magnetic flux density distribution of the magnet roller 302*d* according to an embodiment.

Referring back to FIG. 2, in the developing area A, the developing roller 302 and the photoreceptor 1 are not in contact with each other while forming a predetermined developing gap GP therebetween. The developer 320 forms ears on the developing roller 302 and the ears are brought into contact with the photoreceptor 1 so that toner particles in the developer 320 are adhered to an electrostatic latent image on the photoreceptor 1.

The static shaft 302*a* is connected to a grounded power source. The power source supplies a voltage to the sleeve 302*c* via the conductive rotary shaft 302*e* and the conductive bearings 302*f*. The undermost layer of the photoreceptor 1, i.e., the conductive support, is grounded.

In the developing area A, an electric field is formed so that toner particles separated from carrier particles migrate to the photoreceptor 1 due to the potential difference between the sleeve 302*c* and an electrostatic latent image formed on the photoreceptor 1. The image forming apparatus illustrated in FIG. 1 employs a reversal developing method. In the reversal developing method, the photoreceptor 1 is negatively charged by the charger 2 and subsequently irradiated with the light L based on image information so that a portion corresponding to an image has a reduced surface potential, thus forming an electrostatic latent image. The electrostatic latent image is developed into a toner image by being supplied with negatively-charged toner particles. In another embodiment, the polarities of the photoreceptor 1 and toner particles may be opposite to the present embodiment (i.e., positive).

After the image development, the developer 320 on the developing roller 302 is conveyed downstream as the developing roller 302 rotates and is drawn into the casing 301 by the pole P2. The poles P2 and P3 have the same polarity. The developer 320 cannot form ears on the developing roller 302 between the poles P2 and P3 due to their weak magnetic force. As a result, the developer 320 is separated from the developing roller 302 between the poles P2 and P3. Thus, as illustrated in FIG. 1, a developer separation area 9, in which the developer 320 is separated from the developing roller 302, is formed on the developing roller 302 between the poles P2 and P3. In the developer separation area 9, the magnetic force distribution curve has very low peaks.

The developer 320 served for the image development has a low toner concentration. In case this low-toner-concentration developer is conveyed to the developing area A again without being separated from the developing roller 302, the resulting toner image may have a low image density.

To prevent the above phenomena, the developer served for the image development is separated from the developing roller 302 in the developer separation area 9. The developer separated from the developing roller 302 is sufficiently agitated in the casing 301 so that the toner concentration and toner charge are adjusted. The developer having the adjusted toner concentration and toner charge is fed to a developer retention space C by the supply chamber conveyer 304, as illustrated in FIG. 2.

The developer fed to the developer retention space C is then passed through the developer regulator 303 disposed immediately below the peak of the pole P3. Thus, the developer is formed into a layer having a predetermined thickness on the developing roller 302 and conveyed to the developing area A while forming a magnetic brush. The pole P3 has a function of conveying the developer.

Figure 5:
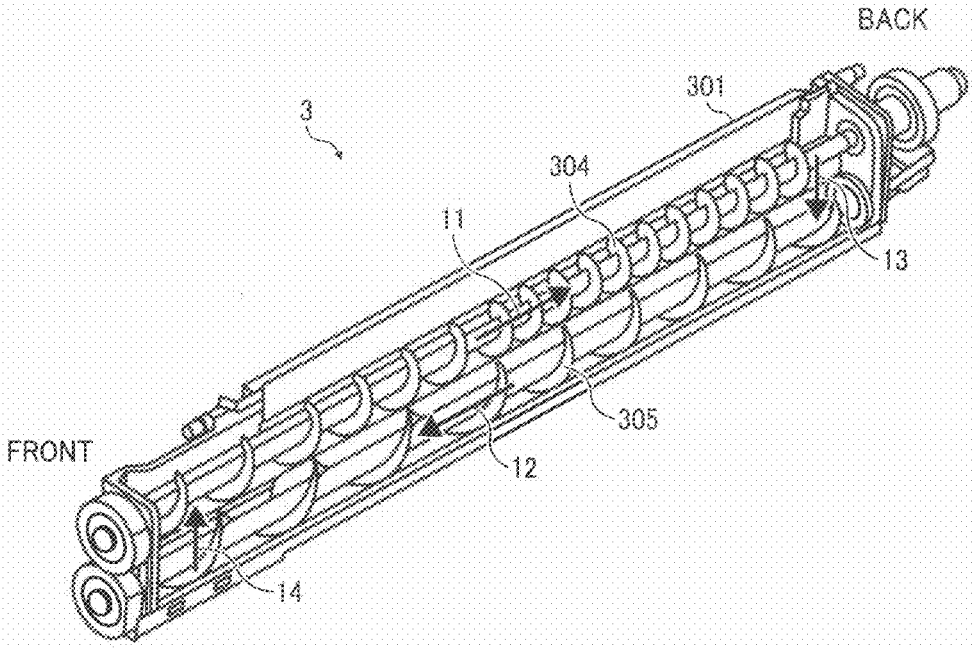
FIG. 5 and FIG. 6 are perspective views of the developing device illustrated in FIG. 2.
Figure 6:
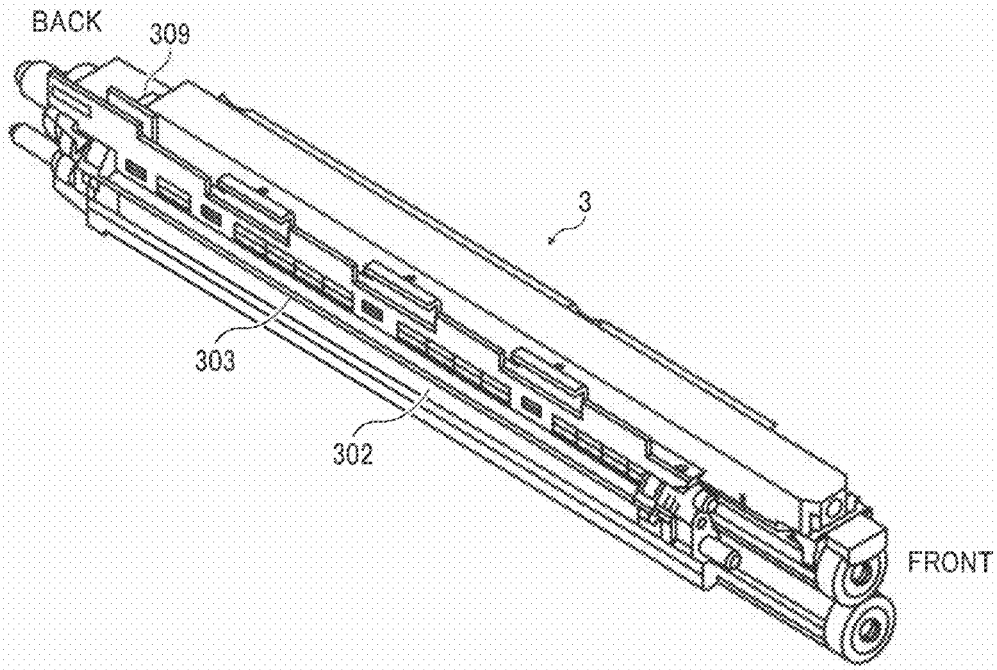

Referring to FIG. 1 and FIG. 2, the supply chamber conveyer 304 is disposed on a right upper side of the developing roller 302. In other words, the supply chamber conveyer 304 is disposed upstream from the developer regulator 303. FIG. 5 and FIG. 6 are perspective views of the developing device 3. As illustrated in FIG. 5, the supply chamber conveyer 304 employs a screw having a spiral around the rotation axis. Referring back to FIG. 1, the supply chamber conveyer 304 rotates clockwise about its center line O-304 that is parallel to the center line O-302 of the developing roller 302. Thus, referring to FIG. 5, the supply chamber conveyer 304 conveys the developer from the front to the back in a longitudinal direction, as indicated by an arrow 11, while agitating the developer. The supply chamber conveyer 304 conveys the developer from the front to the back in an axial direction as it rotates.

Referring to FIG. 1 and FIG. 2, the collection chamber conveyer 305 is disposed on a right lower side of the developing roller 302 being adjacent to the developer separation area 9. As illustrated in FIG. 5, the collection chamber conveyer 305 employs a screw having a spiral around the rotation axis. Referring back to FIG. 1, the collection chamber conveyer 305 rotates counterclockwise about its center line O-305 that is parallel to the center line O-302 of the developing roller 302. Thus, referring to FIG. 5, the collection chamber conveyer 305 conveys the developer from the back to the front in a longitudinal direction, as indicated by an arrow 12, while agitating the developer. The collection chamber conveyer 305 conveys the developer from the back to the front in an axial direction as it rotates, which is opposite to the direction of conveyance of the supply chamber conveyer 304.

The supply chamber conveyer 304 is disposed above the collection chamber conveyer 305. A space around the supply chamber conveyer 304 and a space around the collection chamber conveyer 305 are disposed adjacent to each other within the casing 301. The front ends of the supply chamber conveyer 304 and collection chamber conveyer 305 are both disposed anterior to the front end of the developing roller 302 so that the developer is reliably supplied to the front end of the developing roller 302. The back ends of the supply chamber conveyer 304 and collection chamber conveyer 305 are both disposed posterior to the back end of the developing roller 302 to make an enough space for supplying toner. The developer regulator 303 has the same length as the developing roller 302 in a longitudinal direction.

Figure 7:
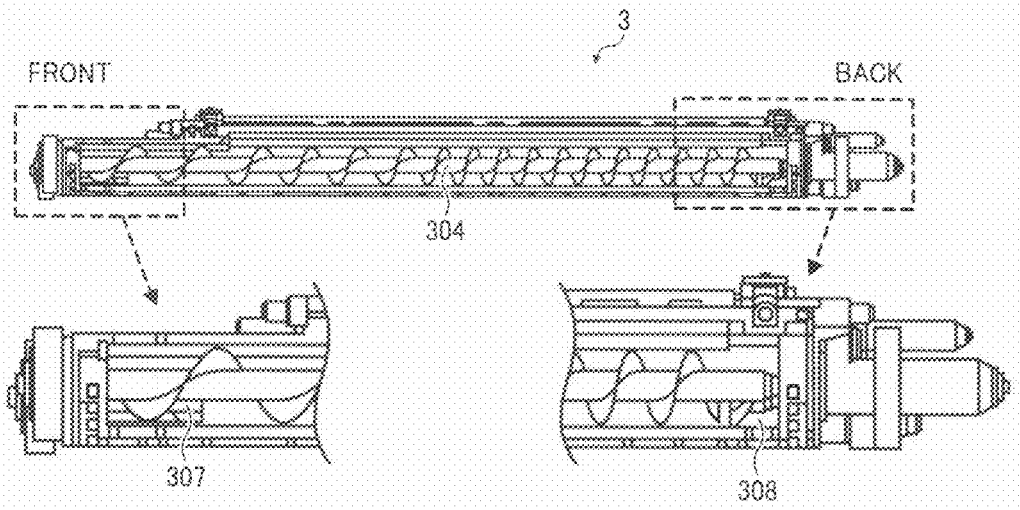
FIG. 7 is a lateral view of the developing device illustrated in FIG. 2.

A divider 306 is disposed in the casing 301 between the supply chamber conveyer 304 and the collection chamber conveyer 305. The divider 306 divides the space around the supply chamber conveyer 304 from the space around the collection chamber conveyer 305. FIG. 7 is a lateral view of the developing device 3. Communication apertures 307 and 308 are disposed on both ends of the divider 306. Referring to FIG. 5 and FIG. 7, the developer conveyed in the direction indicated by the arrow 12 by the collection chamber conveyer 305 accumulates on the front end of the casing 301 and goes up through the communication aperture 307 as indicated by an arrow 14. The developer is then conveyed in the direction indicated by the arrow 11 by the supply chamber conveyer 304.

Similarly, referring to FIG. 5 and FIG. 7, the developer conveyed in the direction indicated by the arrow 11 by the supply chamber conveyer 304 accumulates on the back end of the casing 301 and goes down through the communication aperture 308 as indicated by an arrow 13. The developer is then conveyed in the direction indicated by the arrow 12 by the collection chamber conveyer 305 again. The developing device 3 includes the developing roller 302, the supply chamber conveyer 304, the collection chamber conveyer 305, and the divider 306. The developing roller 302 is rotatable about its center line O-302, and is adapted to bear a developer to develop an electrostatic latent image on the photoreceptor 1 with the developer. The supply chamber conveyer 304 is rotatable about its center line O-304 that is parallel to the center line O-302 of the developing roller 302, and is adapted to convey the developer in a longitudinal direction while agitating the developer. The collection chamber conveyer 305 is rotatable about its center line O-305 that is parallel to the center line O-302 of the developing roller 302, and is adapted to convey the developer in a direction opposite to the direction of conveyance of the supply chamber conveyer 304 while agitating the developer. The collection chamber conveyer 305 is disposed adjacent to the developer separation area 9 in which the developer is separated from the developing roller 302. The divider 306, having communication apertures on both ends, is disposed between the supply chamber conveyer 304 and the collection chamber conveyer 305 to divide the space around the supply chamber conveyer 304 from the space around the collection chamber conveyer 305. Such a configuration forms a developer conveyance path through which the developer is conveyed as indicated by the arrows 11, 13, 12, and 14 within the casing 301. Thus, the developing device 3 has a configuration such that the supply chamber conveyer 304 and the collection chamber conveyer 305 are vertically disposed on a side of the developing roller 302, which is more compact in a horizontal direction compared to a related-art developing device 500 illustrated in FIG. 8 in which two conveyers 502 and 503 are horizontally disposed on a side of a developing roller 501.

Since the divider 306 divides the space around the supply chamber conveyer 304 from the space around the collection chamber conveyer 305, the developing roller 302 is supplied only with the developer 320 from the supply chamber conveyer 304, in which toner particles and carrier particles are well mixed and agitated. The developer served for the image development, having a low toner concentration, is conveyed by the collection chamber conveyer 305 but is not supplied to the developer 320. Thus, the developing roller 302 supplies only toner particles having a desired charge to an electrostatic latent image, thus providing a high-quality toner image. Toner particles are consumed as the developer 320 is repeatedly served for the image development in the developing device 3. Therefore, the developing device 3 is externally supplied with supplemental toner particles. Referring to FIG. 6, supplemental toner particles are supplied from a supply opening 309 disposed adjacent to the back end of the developing device 3. Supplemental toner particles are supplied to a collection chamber through the communication aperture 308 without being directly served for the image development. The developer having a low toner concentration is mixed with the supplemental toner particles by the collection chamber conveyer 305 to have a predetermined toner concentration, and is thereafter served for the image development.

The collection chamber conveyer 305 is adapted only to collect the low-toner-concentration developer separated from the developing roller 302 and not to supply the developer to the developing roller 302. Therefore, the low-toner-concentration developer which is not yet sufficiently mixed with supplemental toner particles supplied from the supply opening 309 is never served for the image development.

The low-toner-concentration developer is sufficiently mixed with the supplemental toner particles by the collection chamber conveyer 305 to have a predetermined toner concentration before reaching the front end of the developing device 3. The developer adjusted to have a predetermined toner concentration then goes up and is conveyed to the back end of the developing device 3 by the supply chamber conveyer 304. Finally, the developer is supplied to the developing roller 302 and served for the image development.

A toner concentration detector is disposed on a lower part and a downstream end of the developing device 3 relative to the direction of conveyance of the collection chamber conveyer 305. The toner concentration detector detects the carrier concentration (i.e., 100—toner concentration) in the developer by measuring magnetic permeability. The toner concentration detector determines the amount of supplemental toner particles to be supplied based on the detected carrier concentration.

Referring to FIG. 5 and FIG. 6, the developer is served for the image development before being conveyed to the back end by the supply chamber conveyer 304. Therefore, the greater amount of the developer is conveyed to the front end by the collection chamber conveyer 305 rather than to the back end by the supply chamber conveyer 304. Thus, the developer is likely to accumulate on the front end. Because the toner concentration detector is disposed on the downstream end relative to the direction of conveyance of the collection chamber conveyer 305 (i.e., the front end), the upper part of the toner concentration detector is always filled with the developer, thus providing reliable detection of the carrier concentration.

Figure 9:
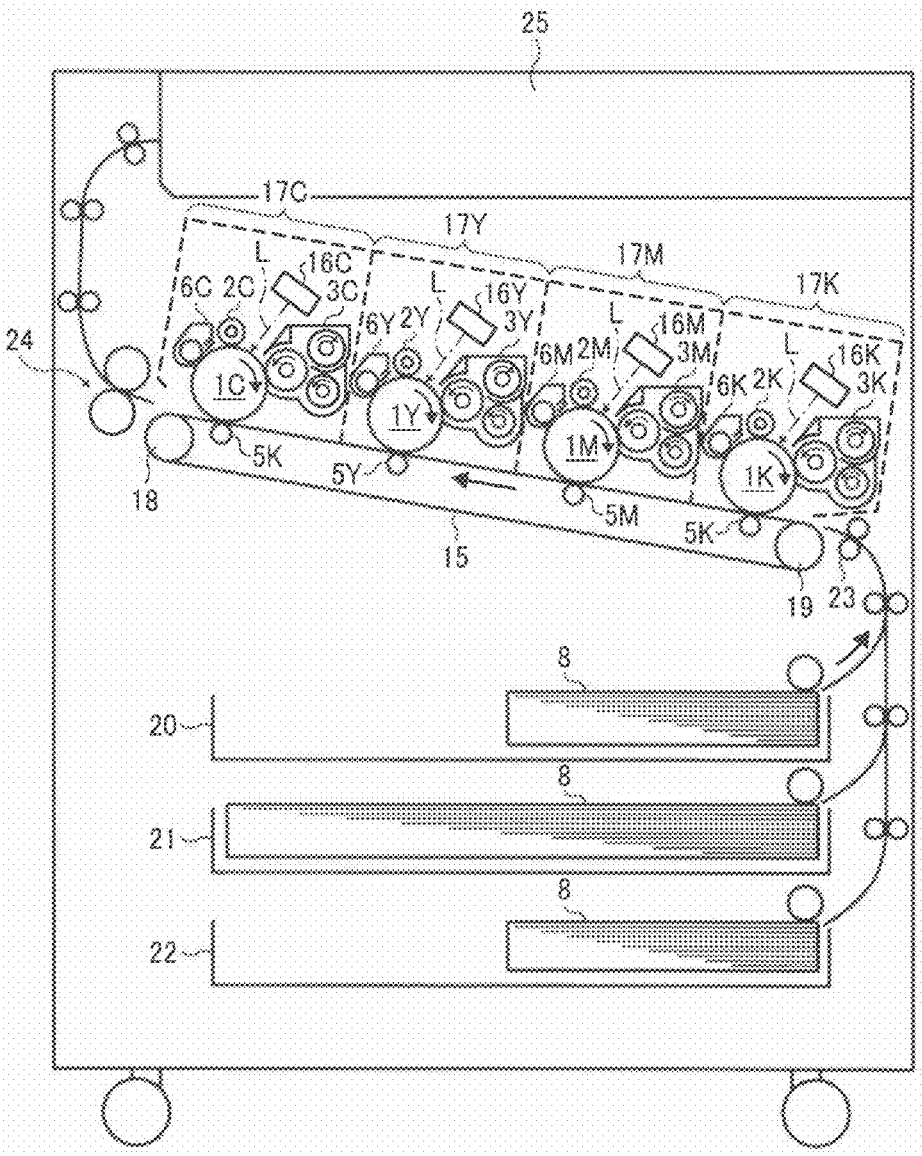
FIG. 9 is a schematic view illustrating a full-color tandem image forming apparatus according to an embodiment

FIG. 9 is a schematic view illustrating a full-color tandem image forming apparatus according to an embodiment. The full-color tandem image forming apparatus includes a conveyer belt 15 adapted to convey a transfer paper 8; and multiple image forming parts 17K, 17M, 17Y, and 17C tandemly disposed in this order along the conveyer belt 15 relative to the direction of conveyance of the conveyer belt 15. The additional characters K, M, Y, and C represent respective toner colors of black, magenta, yellow, and cyan. The arrangement order of the image forming parts is not limited to the above order. For example, in another embodiment, the image forming parts 17M, 17C, 17Y, and 17K are tandemly disposed in this order.

Each of the image forming parts is comprised of multiple members. Each of the image forming parts is not necessarily formed into an independent unit. The image forming parts 17K, 17M, 17Y, and 17C have the same configuration except for containing different color toners of black, magenta, yellow, and cyan, respectively. For the above reason, in the following descriptions, only the image forming part 17K is described in detail. The same reference number will be given to identical constituent elements such as parts and materials having the same functions except for changing the additional characters and redundant descriptions thereof are omitted.

The endless conveyer belt 15 is rotatably supported by conveyer rollers 18 and 19, one of which is a driving roller and the other is a driven roller. The conveyer belt 15 is driven to rotate counterclockwise in FIG. 9 as the conveyer rollers 18 and 19 rotate. Paper feed trays 20, 21, and 22 each adapted to store sheets of the transfer paper 8 are disposed below the conveyer belt 15.

A top sheet of the transfer paper 8 stored in the paper feed tray 20 is conveyed to a registration roller 23. The registration roller 23 once stops feeding the sheet of the transfer paper 8 (hereinafter simply "transfer paper 8") and starts feeding it to the image forming part 17K in synchronization with an occurrence of image formation in the image forming part 17K. The transfer paper 8 is fed to the first image forming part 17K while being electrostatically adsorbed to the conveyer belt 15. Consequently, a black toner image is transferred onto the transfer paper 8.

The image forming part 17K includes a photoreceptor 1K, a charger 2K, a developing device 3K, and a cleaner 6K. A transfer device 5K is disposed facing the photoreceptor 1 with the conveyer belt 15 therebetween. The image forming part 17K further includes an optical scanning device 16K configured to emit light L to the photoreceptor 1 to write an electrostatic latent image thereon.

The charger 2K uniformly charges a surface of the photoreceptor 1K in darkness. The charged surface of the photoreceptor 1K is exposed to light L emitted from the optical scanning device 16K. Thus, an electrostatic latent image is formed on the photoreceptor 1K. The electrostatic latent image formed on the photoreceptor 1K is developed into a black toner image by the developing device 3K.

The black toner image is conveyed to the transfer position where the photoreceptor 1K faces the conveyer belt 15 as the photoreceptor 1K rotates. The transfer device 5K transfers the black toner image at the transfer position from the photoreceptor 1K onto the transfer paper 8 on the conveyer belt 15. The cleaner 6K removes residual toner particles remaining on the surface of the photoreceptor 1K after the black toner image has been transferred from the photoreceptor 1K.

The transfer paper 8 having the black toner image thereon is conveyed from the image forming part 17K to the next image forming part 17M by the conveyer belt 15. In the image forming part 17M, a magenta toner image is formed on a photoreceptor 1M and is transferred onto the black toner image on the transfer paper 8.

The transfer paper 8 is further conveyed to the next image forming part 17Y. In the image forming part 17Y, a yellow toner image is formed on a photoreceptor 1Y and is transferred onto the black and magenta toner images on the transfer paper 8. Similarly, in the next image forming part 17C, a cyan toner image is further transferred onto the black, magenta, and yellow toner images on the transfer paper 8.

The transfer paper 8 having a composite full-color toner image is then separated from the conveyer belt 15 and conveyed to a fixing part 24. The composite full-color toner image is fixed on the transfer paper 8 by passing a pair of fixing rollers in the fixing part 24, and finally discharged onto a discharge tray 25.

In the present embodiment, the photoreceptors 1K, 1M, 1Y, and 1C and corresponding developing devices 3K, 3M, 3Y, and 3C are substantially horizontally disposed. Since each of the developing devices 3K, 3M, 3Y, and 3C according to an embodiment is compact in a horizontal direction, it is possible to reduce intervals between the photoreceptors 1K, 1M, 1Y, and 1C, which results in provision of a compact tandem image forming apparatus.

The developing device according to an embodiment contains magnetic carrier particles having a saturated magnetization of 58 to 70 emu/g in a magnetic field of 1KOe. In the developing device 3 illustrated in FIG. 1, the developer is supplied to the developing roller 302 from an upper side thereof. Therefore, the developer accumulating on the upper side of the developing roller 302 applies a pressure equivalent to its weight to those borne on the developing roller 302. At the same time, as illustrated in FIG. 5, the supply chamber conveyer 304 conveys the developer from the front to the back and the collection chamber conveyer 305 conveys the developer from the back to the front. Since the developer is collected from the developing roller 302 to the collection chamber conveyer 305, the amount of the developer borne on a front side of the developing roller 302 is greater than that borne on a back side of the developing roller 302. Thus, the developer borne on a front side of the developing roller 302 receives a greater pressure than that borne on a back side of the developing roller 302. Due to this pressure difference, it is likely that the developer forms ears more densely on a front side of the developing roller 302 and more sparsely on a back side of the developing roller 302. As a result, it is likely that the resulting solid and halftone images may be lacking in uniformity. When the magnetic carrier particles have a saturated magnetization of 58 emu/g or more in a magnetic field of 1KOe, the developer can be uniformly pressed against the developing roller 302. Thus, the developer can form uniform ears over the entire surface of the developing roller 302 even when receiving nonuniform pressure, preventing production of nonuniform images.

When the saturated magnetization of the magnetic carrier particles is too large, the developer may form ears too densely, resulting in formation of stiff ears. Undesirably, the stiff ears may strongly rub an electrostatic latent image on the photoreceptor 1 in the developing area A, resulting in production of defective images. In view of this, the saturated magnetization of the magnetic carrier particles is not greater than 70 emu/g in a magnetic field of 1KOe.

Saturated magnetization in a magnetic field of 1KOe is measured with a magnetometer VSM-P7-15 (from Toei Industry Co., Ltd.) as follows. Fill a measuring cell having an inner diameter of 2.4 mm and a height of 8.5 mm with about 0.15 g of a sample and subject the sample to a measurement under a magnetic field of 1KOe.

The magnetic carrier particles may comprise a core material such as ferrite, Cu—Zn ferrite, Mn ferrite, Mn—Mg ferrite, Mn—Mg—Sr ferrite, magnetite, iron, and nickel.

For example, ferrite core particles can be prepared as follows. Weigh appropriate amounts of raw materials (e.g., MnO, MgO, $Fe_2O_3$, $SrCO_3$) and disperse them in an appropriate amount of water using a disperser, such as a ball mill or a vibration mill, for 0.5 to 24 hours, to prepare a slurry. Dry the slurry, pulverize the dried product, and pre-burn the pulverized product at 500 to 1,500° C. Pulverize the pre-burnt product into particles having a desired particle diameter using a ball mill. Mix the particles with water, a binder resin, and other optional additives, and spray-dry the mixture into grains. Burn the grains in a furnace at 800 to 1,600° C. Pulverize and classify the burnt grains to obtain particle having a desired particle size. Re-oxidize the surfaces of the obtained particles again, if needed. Saturated magnetization depends on the kind of raw materials used, the burning temperature, and/or whether an oxidization treatment is done or not.

In some embodiments, the two-component developer has a bulk density of 1.69 to 1.85 g/cm$^3$. When the bulk density is less than 1.69 g/cm$^3$, it means that the distance between carrier particles in the developer is too large. Thus, the density of developer ears on the developing roller 302 is nonuniform due to a pressure difference between the front and back of the developing roller 302, resulting in production of nonuniform images. When the bulk density is greater than 1.85 g/cm$^3$, it means that the volume of the developer bulk is too small. Thus, it is likely that the developer is depleted at the front of the developing roller 302, resulting in production of an image with a low-image-density portion on the front. This phenomenon is likely to occur in a case in which the toner concentration decreases, such as a case in which a solid image is continuously formed.

Bulk density of the two-component developer is measured based on a method according to JIS Z2504 (Metallic powders—Determination of apparent density—Funnel method). The orifice diameter is set to 5.0 mm. Bulk density of the two-component developer depends on the amount of surface wax of the toner, circularity of the toner, particle size distribution of the toner, surface profile of the carrier, and/or magnetization of the carrier.

In some embodiments, the magnetic carrier particles have a surface roughness Ra of 0.38 to 0.90 μm. When the surface roughness Ra is greater than 0.90 μm, the distance between carrier particles in the developer is too large because the carrier surface is too rough. Thus, the density of developer ears on the developing roller 302 is nonuniform due to a pressure difference between the front and back of the developing roller 302, resulting in production of nonuniform images. When the surface roughness Ra is less than 0.38 μm, fluidity of the carrier particles is too high because the carrier surface is too smooth. As a result, the developer may form ears too densely, resulting in formation of stiff ears. Undesirably, the stiff ears may strongly rub an electrostatic latent image on the photoreceptor 1 in the developing area A, resulting in production of defective images.

Surface roughness Ra of the magnetic carrier particles is measured as follows. Observe the surface of a magnetic carrier particle with a confocal microscope OPTELICS® C130 (from Lasertec Corporation) and set a field of view to 10 μm×10 μm. Measure the heights within the field of view and determine the center line. Sum the absolute deviations of a measured curve from the center line and average the sum. Surface roughness Ra of the magnetic carrier particles depends on the mixing ratio of resins in its covering layer (to be described later), the amount and kind of conductive particles included in the covering layer, the thickness of the covering layer, and the viscosity of the covering layer liquid.

In some embodiments, each of the magnetic carrier particles has a covering layer comprising a binder resin and conductive fine particles, and satisfies the following formula $0.5 \leq D/h \leq 1.1$, wherein D represents the average particle diameter of the conductive fine particles and h represents the thickness of the covering layer. When D/h is less than 0.5, it is likely that the conductive fine particles are buried in the binder resin. In this case, the fluidity of the magnetic carrier particles is too high due to its smooth surface. As a result, the developer may form ears too densely, resulting in formation of stiff ears. Undesirably, the stiff ears may strongly rub an electrostatic latent image on the photoreceptor 1 in the developing area A, resulting in production of defective images. When D/h is greater than 1.1, the distance between carrier particles in the developer is too large because the carrier surface is too rough. Thus, the density of developer ears on the developing roller 302 is nonuniform due to a pressure difference between the front and back of the developing roller 302, resulting in production of nonuniform images.

The thickness h of the covering layer is determined by observing a cross-section of the magnetic carrier particles using a transmission electron microscope (TEM). In particular, the thickness h is determined only from the thicknesses of the binder resin portions lying between a surface portion of the core particle and each conductive fine particle. The binder resin portions lying between two conductive fine particles or those lying between a surface portion of the covering layer and each conducive particle are not taken into consideration. Specifically, the thickness h is the average thickness among 50 randomly-selected portions of the covering layer observed in the cross-section of the magnetic carrier particle. The average particle diameter D of the conductive fine particles is determined by measuring the volume average particle diameter by an automatic particle size distribution analyzer CAPA-700 (from Horiba, Ltd.) as follows. First, fill a juicer mixer with 30 ml of an aminosilane (SH6020 from Dow Corning Toray Co., Ltd.) and 300 ml of a toluene solution. Add 6.0 mg of a sample and disperse the sample for 3 minutes while setting the rotation speed of the mixer to a level "low". Add several drops of the resulting dispersion to 500 ml of a toluene solution contained in a 1,000-ml beaker to dilute the dispersion. Keep agitating the diluted dispersion with a homogenizer. Subject the diluted dispersion to a measurement by the automatic particle size distribution analyzer CAPA-700 (from Horiba, Ltd.) under the following measurement conditions.

Rotation speed: 2,000 rpm
Maximum particle size: 2.0 μm
Minimum particle size: 0.1 μm
Particle size interval: 0.1 μm
Dispersion medium viscosity: 0.59 mPa·s
Dispersion medium density: 0.87 g/cm$^3$
Particle density: Input an absolute specific gravity measured by a micromeritics gas pycnometer Accupyc 1330 (from Shimadzu Corporation).

In some embodiments, the binder resin includes a silicone resin and an acrylic resin. The two resins form a sea-island structure in the covering layer, and the sea-island structure appropriately forms convexities and concavities on the surface of the magnetic carrier particles. Such carrier particles can keep a proper distance form each other and are prevented from producing defective images with uneven image density or undesired lines. In some embodiments, the ratio of the acrylic resin to the silicone resin is 1/9 to 5/5. When the ratio is less than 1/9, the amount of the acrylic resin is too small to form a sea-island structure. When the ratio is greater than 5/5, the amount of the acrylic resin is so large that the resulting carrier particles are likely to aggregate.

Usable silicone resins include, but are not limited to, a straight silicone resin consisting of organosiloxane bonds, a modified silicone resin modified with an alkyd resin, a polyester resin, an epoxy resin, an acrylic resin, or a urethane resin. Specific examples of commercially available silicone resins include, but are not limited to, KR271, KR255, and KR152 (from Shin-Etsu Chemical Co., Ltd.); and SR2400, SR2406, and SR2410 (from Dow Corning Toray Co., Ltd.). The silicone resin can be used alone or in combination with other components such as a cross-linking component and a charge controlling component. Specific examples of commercially available modified silicone resins include, but are not limited to, KR206 (alkyd-modified), KR5208 (acrylic-modified), ES1001N (epoxy-modified), and KR305 (urethane-modified) (from Shin-Etsu Chemical Co., Ltd.); and SR2115 (epoxy-modified) and SR2110 (alkyd-modified) (from Dow Corning Toray Co., Ltd.).

Usable acrylic resins include all resins having an acrylic component. The acrylic resin can be used alone or in combination with at least one cross-linking component, such as an amino rein and an acidic catalyst. The amino resin may be, for example, a guanamine resin or a melamine resin. The acidic catalyst may be, for example, a catalyst having a reactive group of a completely alkylated type, a methylol group type, an imino group type, or a methylol/imino group type.

In some embodiments, the covering layer includes a silane coupling agent to reliably disperse the conductive fine particles. Specific examples of usable silane coupling agents include, but are not limited to, γ-(2-aminoethyl)aminopropyl trimethoxysilane, γ-(2-aminoethyl)aminopropylmethyl dimethoxysilane, γ-methacryloxypropyl trimethoxysilane, N-β-(N-vinylbenzylaminoethyl)-γ-aminopropyl trimethoxysilane hydrochloride, γ-glycidoxypropyl trimethoxysilane, γ-mercaptopropyl trimethoxysilane, methyl trimethoxysilane, methyl triethoxysilane, vinyl triacetoxysilane, γ-chloropropyl trimethoxysilane, hexamethyl disilazane, γ-anilinopropyl trimethoxysilane, vinyl trimethoxysilane, octadecyldimethyl[3-(trimethoxysilyl)propyl]ammonium chloride, γ-chloropropylmethyl dimethoxysilane, methyl trichlorosilane, dimethyl dichlorosilane, trimethyl chlorosilane, allyl triethoxysilane, 3-aminopropylmethyl diethoxysilane, 3-aminopropyl trimethoxysilane, dimethyl diethoxysilane, 1,3-divinyltetramethyl disilazane, and methacryloxyethyldimethyl(3-trimethoxysilylpropyl)ammonium chloride. Two or more of these materials can be used in combination.

Specific examples of commercially available silane coupling agents include, but are not limited to, AY43-059, SR6020, SZ6023, SH6026, SZ6032, SZ6050, AY43-310M, SZ6030, SH6040, AY43-026, AY43-031, sh6062, Z-6911, sz6300, sz6075, sz6079, sz6083, sz6070, sz6072, Z-6721, AY43-004, Z-6187, AY43-021, AY43-043, AY43-040, AY43-047, Z-6265, AY43-204M, AY43-048, Z-6403, AY43-206M, AY43-206E, Z6341, AY43-210MC, AY43-083, AY43-101, AY43-013, AY43-158E, Z-6920, and Z-6940 (from Dow Corning Toray Co., Ltd.).

In some embodiments, the content of the silane coupling agent is 0.1 to 10% by weight based on the silicone resin. When the content of the silane coupling agent is less than 0.1% by weight, adhesiveness between the silicone resin and the core particle or conductive fine particles may be poor. When the content of the silane coupling agent is greater than 10% by weight, toner filming may occur in a long-term use.

The condensation reaction for preparing the silicone resin can be accelerated by using a titanium-based catalyst, a tin-based catalyst, a zirconium-based catalyst, or an aluminum-based catalyst. In some embodiments, a titanium-based catalyst is used. In some embodiments, a titanium alkoxide catalyst or a titanium chelate catalyst is used. The above catalysts effectively accelerate the condensation reaction of silanol groups while keeping good catalytic ability. Specific examples of the titanium alkoxide catalysts include, but are not limited to, titanium diisopropoxy bis(ethylacetoacetate) having the following formula (1). Specific examples of the titanium chelate catalysts include, but are not limited to, titanium diisopropoxy bis(triethanolaminate) having the following formula (2).

$$Ti(O\text{-}i\text{-}C_3H_7)_2(C_6H_9O_3)_2 \quad (1)$$

$$Ti(O\text{-}i\text{-}C_3H_7)_2(C_6H_{14}O_3N)_2 \quad (2)$$

In some embodiments, the magnetic carrier particles have a weight average particle diameter of 25 to 45 μm. When the weight average particle diameter is less than 25 μm, carrier deposition may occur. When the weight average particle diameter is greater than 45 μm, the resulting image may not precisely reproduce thin lines. The weight average particle diameter can be measured by a Microtrac particle size analyzer HRA9320-X100 (from Nikkiso Co., Ltd.).

In some embodiments, the covering layer has an average thickness of 0.05 to 4 μm. When the average thickness is less than 0.05 μm, the covering layer may be easily destroyed or abraded. When the average thickness is greater than 4 μm, the carrier particles may easily adhere to the resulting images because the covering layer has no magnetic property.

A two-component developer according to an embodiment includes the above-described magnetic carrier particles and toner particles. The toner includes a binder resin and a colorant. The toner may be either a monochrome toner for producing monochrome images or a full-color toner for producing full-color images. The toner may further include a release agent so as to be usable in oilless fixing systems in which no oil is applied to a fixing member. Although such a toner including a release agent easily causes filming, the magnetic carrier according to an embodiment can prevent the occurrence of filming. Therefore, the developer according to an embodiment can provide high-quality images for an extended period of time. Because the magnetic carrier particles according to an embodiment prevent peeling off of the resin layer, even yellow images may not be contaminated.

The toner can be manufactured by known methods such as pulverization methods and polymerization methods. In a typical pulverization method, raw materials are melt-kneaded and cooled, the melt-kneaded mixture is pulverized into particles, and the particles are classified by size to prepare mother particles. Further, an external additive is externally added to the mother particles to improve transferability and durability. Specific examples of usable kneaders include, but are not limited to, a batch-type double roll mill; Banbury mixer; double-axis continuous extruders such as TWIN SCREW EXTRUDER KTK (from Kobe Steel, Ltd.), TWIN SCREW COMPOUNDER TEM (from Toshiba Machine Co., Ltd.), MIRACLE K.C.K (from Asada Iron Works Co., Ltd.), TWIN SCREW EXTRUDER PCM (from Ikegai Co., Ltd.), and KEX EXTRUDER (from Kurimoto, Ltd.); and single-axis continuous extruders such as KONEADER (from Buss Corporation).

The cooled melt-kneaded mixture is pulverized into coarse particles by a hammer mill or a roatplex, and the coarse particles are pulverized into fine particles by a jet-type pulverizer or a mechanical pulverizer. In some embodiments, the pulverization condition is set so that toner particles having an average particle diameter of 3 to 15 μm are obtained. The pulverized particles may be classified by a wind-power classifier. In some embodiments, the classification condition is set so that mother particles having an average particle diameter of 5 to 20 μm are collected. The external additive and the mother particles are mixed and agitated by a mixer so that the external additive is adhered to the surfaces of the mother particles while being pulverized by the agitation.

Specific examples of usable binder resins for the toner include, but are not limited to, homopolymers of styrene or styrene derivatives (e.g., polystyrene, poly-p-styrene, polyvinyl toluene), styrene-based copolymers (e.g., styrene-p-chlorostyrene copolymer, styrene-propylene copolymer, styrene-vinyltoluene copolymer, styrene-methyl acrylate copolymer, styrene-ethyl acrylate copolymer, styrene-methacrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ether copolymer, styrene-vinyl methyl ketone copolymer, styrene-butadiene copolymer, styrene-isoprene copolymer, styrene-maleate copolymer), polymethyl methacrylate, polybutyl methacrylate, polyvinyl chloride, polyvinyl acetate, polyethylene, polyester, polyurethane, epoxy resin, polyvinyl butyral, polyacrylic acid resin, rosin, modified rosin, terpene resin, phenol resin, aliphatic or aromatic hydrocarbon resin, and aromatic petroleum resin. Two or more of these resins can be used in combination.

Additionally, the following binder resins for pressure fixing can also be used: polyolefin resins (e.g., low-molecular-weight polyethylene, low-molecular-weight polypropylene), olefin copolymers (e.g., ethylene-acrylic acid copolymer, ethylene-acrylate copolymer, styrene-methacrylic acid copolymer, ethylene-methacrylate copolymer, ethylene-vinyl chloride copolymer, ethylene-vinyl acetate copolymer, ionomer resin), epoxy resin, polyester resin, styrene-butadiene copolymer, polyvinyl pyrrolidone, methyl vinyl ether-malic acid anhydride copolymer, maleic-acid-modified phenol resin, and phenol-modified terpene resin. Two or more of these resins can be used in combination.

Specific examples of usable colorants (e.g., pigments, dyes) include, but are not limited to, yellow colorants such as Cadmium Yellow, Mineral Fast Yellow, Nickel Titan Yellow, Naples Yellow, Naphthol Yellow S, Hansa Yellow G, Hansa Yellow 10G, Benzidine Yellow GR, Quinoline Yellow Lake, Permanent Yellow NCG, and Tartrazine Lake; orange colorants such as Molybdenum Orange, Permanent Orange GTR, Pyrazolone Orange, Vulcan Orange, Indanthrene Brilliant Orange RK, Benzidine Orange G, and Indanthrene Brilliant Orange GK; red colorants such as Colcothar, Cadmium Red, Permanent Red 4R, Lithol Red, Pyrazolone Red, Watching Red Calcium Salt, Lake Red D, Brilliant Carmine 6B, Eosin Lake, Rhodamine Lake B, Alizarine Lake, and Brilliant Carmine 3B; violet colorants such as Fast Violet B and Methyl Violet Lake; blue colorants such as Cobalt Blue, Alkali Blue, Victoria Blue Lake, Phthalocyanine Blue, Metal-free Phthalocyanine Blue, Phthalocyanine Blue Partial Chloride, Fast Sky Blue, and Indanthrene Blue BC; green colorants such as Chrome Green, Chrome Oxide, Pigment Green B, and Malachite Green Lake; and black pigments such as azine dyes (e.g., Carbon Black, Oil Furnace Black, Channel Black, Lamp Black, Acetylene Black, Aniline Black), metal salt azo dyes, metal oxides, and complex metal oxides. Two or more of these colorants can be used in combination.

Specific examples of usable release agents include, but are not limited to, polyolefins (e.g., polyethylene, polypropylene), fatty acid metal salts, fatty acid esters, paraffin waxes, amide waxes, polyvalent alcohol waxes, silicone varnishes, carnauba waxes, and ester waxes. Two or more of these materials can be used in combination.

The toner may further include a charge controlling agent. Specific examples of usable charge controlling agents include, but are not limited to, nigrosine dyes, azine dyes having an alkyl group having 2 to 16 carbon atoms described in Examined Japanese Application Publication No. 42-1627, the disclosures thereof being incorporated herein by reference; basic dyes (e.g., C. I. Basic Yellow 2 (C. I. 41000), C. I. Basic Yellow 3, C. I. Basic Red 1 (C. I. 45160), C. I. Basic Red 9 (C. I. 42500), C. I. Basic Violet 1 (C. I. 42535), C. I. Basic Violet 3 (C. I. 42555), C. I. Basic Violet 10 (C. I. 45170), C. I. Basic Violet 14 (C. I. 42510), C. I. Basic Blue 1 (C. I. 42025), C. I. Basic Blue 3 (C. I. 51005), C. I. Basic Blue 5 (C. I. 42140), C. I. Basic Blue 7 (C. I. 42595), C. I. Basic Blue 9 (C. I. 52015), C. I. Basic Blue 24 (C. I. 52030), C. I. Basic Blue 25 (C. I. 52025), C. I. Basic Blue 26 (C. I. 44045), C. I. Basic Green 1 (C. I. 42040), C. I. Basic Green 4 (C. I. 42000)) and lake pigments thereof; quaternary ammonium salts (e.g., C. I. Solvent Black 8 (C. I. 26150), benzoylmethylhexadecyl ammonium chloride, decyltrimethyl chloride); dialkyl (e.g., dibutyl, dioctyl) tin compounds; dialkyl tin borate compounds; guanidine derivatives; polyamine resins (e.g., vinyl polymers having amino group, condensed polymers having amino group); metal complex salts of monoazo dyes described in Examined Japanese Application Publication Nos. 41-20153, 43-27596, 44-6397, and 45-26478, the disclosures thereof being incorporated herein by reference; metal complexes of salicylic acid, dialkyl salicylic acid, naphthoic acid, and dicarboxylic acid with Zn, Al, Co, Cr, and Fe, described in Examined Japanese Application Publication Nos. 55-42752 and 59-7385, the disclosures thereof being incorporated herein by reference; sulfonated copper phthalocyanine pigments; organic boron salts; fluorine-containing quaternary ammonium salts; and calixarene compounds. Two or more of these materials can be used in combination. In some embodiments, the toners having colors other than black include a white metal salt of a salicylic acid derivative.

Specific examples of usable external additives include, but are not limited to, inorganic particles of silica, titanium oxide, alumina, silicon carbide, silicon nitride, and boron nitride; and resin particles of polymethyl methacrylate or polystyrene having an average particle diameter of 0.05 to 1 μm, which are obtained by a soap-free emulsion polymerization. Two or more of these materials can be used in combination. In some embodiments, hydrophobized metal oxides such as silica and titanium oxide are used. When a hydrophobized silica and a hydrophobized titanium oxide are used in combination and the amount of the hydrophobized titanium oxide is greater than that of the hydrophobized silica, the toner has excellent charge stability regardless of humidity.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

Example 1

Preparation of Carrier

A covering layer liquid is prepared by dispersing 51.3 parts of an acrylic resin solution (HITALOID 3001 from Hitachi Chemical Co., Ltd.) having a solid content of 50%, 14.6 parts of a guanamine solution (MYCOAT 106 from MT AquaPolymer, Inc.) having a solid content of 70%, 0.29 parts of an acidic catalyst (CATALYST 4040 from MT AquaPolymer, Inc.) having a solid content of 40%, 648 parts of a silicone resin solution (SR2410 from Dow Corning Toray Co., Ltd.) having a solid content of 20%, 3.2 parts of an aminosilane (SH6020 from Dow Corning Toray Co., Ltd.) having a solid content of 100%, 165 parts of conductive fine particles (EC-500 from Titan Kogyo, Ltd.) having an average particle diameter of 0.43 μm and an absolute specific gravity of 4.6, and 1,800 parts of toluene, for 10 minutes using a HOMOMIXER. The covering layer liquid is applied to the surfaces of 5,000 parts of Mn ferrite particles having an average particle diameter of 35 μm using a SPIRA COTA (from Okada Seiko Co., Ltd.) at an inner temperature of 55° C., followed by drying, so that the resulting covering layer has a thickness of 0.55 μm. The ferrite particles having the covering layer are burnt in an electric furnace for 1 hour at 200° C. The resulting bulk of the ferrite particles is then pulverized with a sieve having openings of 63 μm. Thus, a carrier 1 having a D/h of 0.8, a surface roughness Ra of 0.51 μm, and a magnetization of 64 emu/g is prepared.

The average particle diameter of the core particles is measured with a Microtrac particle size analyzer SRA (from Nikkiso Co., Ltd.) while setting the measuring range to between 0.71 and 125 μm.

The average thickness of the covering layer is determined by observing a cross-section of the carrier using a transmission electron microscope (TEM).

The magnetization is measured with a magnetometer VSM-P7-15 (from Toei Industry Co., Ltd.) as follows. Fill a measuring cell having an inner diameter of 2.4 mm and a height of 8.5 mm with about 0.15 g of a sample and subject the sample to a measurement under a magnetic field of 1KOe.

Preparation of Toner 1

Preparation of Polyester Resin A

A reaction vessel equipped with a condenser, a stirrer, and a nitrogen inlet pipe is charged with 65 parts of ethylene oxide 2 mol adduct of bisphenol A, 86 parts of propylene oxide 3 mol adduct of bisphenol A, 274 parts of terephthalic acid, and 2 parts of dibutyltin oxide. The mixture is subjected to a reaction for 15 hours at 230° C. under normal pressures. The mixture is further subjected to a reaction for 6 hours under reduced pressures of 5 to 10 mmHg. Thus, a polyester resin A is prepared. The polyester resin A has a number average molecular weight (Mn) of 2,300, a weight average molecular weight (Mw) of 8,000, a glass transition temperature (Tg) of 58° C., an acid value of 25 mgKOH/g, and a hydroxyl value of 35 mgKOH/g.

Preparation of Styrene-Acrylic Resin A

A reaction vessel equipped with a condenser, a stirrer, and a nitrogen inlet pipe is charged with 300 parts of ethyl acetate, 185 parts of styrene, 115 parts of an acrylic monomer, and 5 parts of azobis isobutylnitrile. The mixture is subjected to a reaction for 8 hours at 65° C. in nitrogen atmosphere under normal pressures. After adding 200 parts of methanol, the mixture is further agitated for 1 hour, followed by removing supernatant liquid and drying under reduced pressures. Thus, a styrene-acrylic resin A is prepared. The styrene-acrylic resin A has a weight average molecular weight (Mw) of 20,000 and a glass transition temperature (Tg) of 58° C.

Preparation of Prepolymer (Polymer Reactive with Compound Having Active Hydrogen Group)

A reaction vessel equipped with a condenser, a stirrer, and a nitrogen inlet pipe is charged with 682 parts of ethylene oxide 2 mol adduct of bisphenol A, 81 parts of propylene oxide 2 mol adduct of bisphenol A, 283 parts of terephthalic acid, 22 parts of trimellitic anhydride, and 2 parts of dibutyltin oxide. The mixture is subjected to a reaction for 8 hours at 230° C. under normal pressures. The mixture is further subjected to a reaction for 5 hours under reduced pressures of 10 to 15 mmHg. Thus, an intermediate polyester is prepared. The intermediate polyester has a number average molecular weight (Mn) of 2,100, a weight average molecular weight (Mw) of 9,600, a glass transition temperature (Tg) of 55° C., an acid value of 0.5, and a hydroxyl value of 49.

Another reaction vessel equipped with a condenser, a stirrer, and a nitrogen inlet pipe is charged with 411 parts of the intermediate polyester, 89 parts of isophorone diisocyanate, and 500 parts of ethyl acetate. The mixture is subjected to a reaction for 5 hours at 100° C. Thus, a prepolymer (i.e., a polymer reactive with a compound having an active hydrogen group) is prepared. The prepolymer has a free isocyanate content of 1.60% and a solid content of 50% (after being left for 45 minutes at 150° C.).

Preparation of Ketimine (Compound Having Active Hydrogen Group)

A reaction vessel equipped with a stirrer and a thermometer is charged with 30 parts of isophoronediamine and 70 parts of methyl ethyl ketone. The mixture is subjected to a reaction for 5 hours at 50° C. Thus, a ketimine compound (I.e., a compound having an active hydrogen group) is prepared. The ketimine compound has an amine value of 423.

Preparation of Master Batch

First, 1,000 parts of water, 540 parts of a carbon black (PRINTEX 35 from Degussa) having a DBP oil absorption of 42 ml/100 g and a pH of 9.5, and 1,200 parts of the polyester resin A are mixed using a HENSCHEL MIXER (from Mitsui Mining and Smelting Co., Ltd.). The resulting mixture is kneaded for 30 minutes at 150° C. using double rolls, the kneaded mixture is then rolled and cooled, and the rolled mixture is then pulverized into particles using a pulverizer (from Hosokawa Micron Corporation). Thus, a master batch is prepared.

Preparation of Aqueous Medium

An aqueous medium is prepared by mixing and agitating 306 parts of ion-exchange water, 265 parts of a 10% suspension of tricalcium phosphate, and 1.0 part of sodium dodecylbenzenesulfonate.

Measurement of Critical Micelle Concentration

The critical micelle concentration of a surfactant can be measured with a surface tensiometer SIGMA (from KSV Instruments) and an analysis program software for SIGMA as follows. Drop the surfactant in an amount of 0.01% by weight in an aqueous medium while agitating the aqueous medium and leave the aqueous medium as it stands to measure the surface tension. Repeat this operation to compile a surface tension-surfactant concentration curve. Referring to the compiled surface tension-surfactant concentration curve, the critical micelle concentration is determined from a surfactant concentration above which the surface tension does not decrease. According to the above measuring method, the critical micelle concentration of the sodium dodecylbenzenesulfonate in the aqueous medium is 0.05% by weight.

Preparation of Toner Components Liquid

In a beaker, 70 parts of the polyester resin A and 10 parts of the prepolymer are dissolved in 100 parts of ethyl acetate. Further, 5 parts of a paraffin wax (HNP-9 from Nippon Seiro Co., Ltd.) having a melting point of 75° C., 2 parts of MEK-ST (from Nissan Chemical Industries, Ltd.), and 10 parts of the master batch are added to the beaker. The resulting mixture is subjected to a dispersion treatment using a bead mill (ULTRAVISCOMILL (trademark) from Aimex Co., Ltd.) filled with 80% by volume of zirconia beads having a diameter of 0.5 mm, at a liquid feeding speed of 1 kg/hour and a disc peripheral speed of 6 msec. This dispersing operation is repeated 3 times (3 passes). Thereafter, 2.7 parts of the ketimine compound are further added to the mixture. Thus, a toner components liquid is prepared.

Preparation of Emulsion Slurry

While agitating 150 parts of the aqueous medium in a vessel at a revolution of 12,000 rpm using a TK HOMOMIXER (from PRIMIX Corporation), 100 parts of the toner components liquid are mixed therein for 10 minutes. Thus, an emulsion slurry is prepared.

Removal of Organic Solvents

A flask equipped with a stirrer and a thermometer is charged with 100 parts of the emulsion slurry. The emulsion slurry is agitated for 12 hours at 30° C. at a peripheral speed of 20 m/min so that the organic solvents are removed therefrom. Thus, a dispersion slurry is prepared.

Washing

First, 100 parts of the dispersion slurry is filtered under reduced pressures, and mixed with 100 parts of ion-exchange water using a TK HOMOMIXER for 10 minutes at a revolution of 12,000 rpm, followed by filtering, thus obtaining a wet cake (i). The wet cake (i) is mixed with 300 parts of ion-exchange water using a TK HOMOMIXER for 10 minutes at a revolution of 12,000 rpm, followed by filtering. This operation is repeated twice, thus obtaining a wet cake (ii). The wet cake (ii) is mixed with 20 parts of a 10% aqueous solution of sodium hydroxide using a TK HOMOMIXER for 30 minutes at a revolution of 12,000 rpm, followed by filtering under reduced pressures, thus obtaining a wet cake (iii). The wet cake (iii) is mixed with 300 parts of ion-exchange water using a TK HOMOMIXER for 10 minutes at a revolution of 12,000 rpm, followed by filtering, thus obtaining a wet cake (iv). The wet cake (iv) is mixed with 300 parts of ion-exchange water using a TK HOMOMIXER for 10 minutes at a revolution of 12,000 rpm, followed by filtering. This operation is repeated twice, thus obtaining a wet cake (v). The wet cake (v) is mixed with 20 parts of a 10% hydrochloric acid using a TK HOMOMIXER for 10 minutes at a revolution of 12,000 rpm, followed by filtering, thus obtaining a wet cake (vi).

Surfactant Content Control

The wet cake (vi) is mixed with 300 parts of ion-exchange water using a TK HOMOMIXER for 10 minutes at a revolution of 12,000 rpm. The resulting dispersion is subjected to a measurement of electric conductivity to determine the surfactant concentration referring to the calibration curve previously compiled. The dispersion is supplied with additional ion-exchange water so that the surfactant concentration becomes 0.05% by weight. Thus, a toner dispersion is prepared.

Surface Treatment

The above-prepared toner dispersion having a predetermined surfactant concentration is heated to 55° C. (T1) in a water bath for 10 hours while being agitated by a TK HOMOMIXER at a revolution of 5,000 rpm. Thereafter, the toner dispersion is cooled to 25° C. and filtered. The filtered cake is mixed with 300 parts of ion-exchange water using a TK HOMOMIXER for 10 minutes at a revolution of 12,000 rpm, followed by filtering.

Drying

The cake thus obtained is dried by a drier for 48 hours at 45° C., and filtered with a mesh having openings of 75 μm. Thus, a mother toner 1 is prepared.

External Treatment

The mother toner 1 in an amount of 100 parts is mixed with 0.6 parts of a hydrophobized silica having an average particle diameter of 100 nm, 1.0 part of a titanium oxide having an average particle diameter of 20 nm, and 0.8 parts of a hydrophobized silica powder having an average particle diameter of 15 nm using a HENSCHEL MIXER. Thus, a toner 1 is prepared.

Further, 7 parts of the toner 1 and 93 parts of the carrier 1 are mixed to prepare a developer 1. The developer 1 has a bulk density of 1.73 g/cm$^3$.

The properties of the developer 1 are shown in the following Table 1.

The developer 1 is subjected to the following evaluations.

The developer 1 is set in the developing device illustrated in FIG. 1 for the image forming apparatus illustrated in FIG. 9 to perform a running test in which a monochrome image chart having an image area ratio of 20% is continuously formed on 200,000 sheets of paper. After the running test, the produced image is evaluated in terms of image density unevenness in both solid and halftone images, ear marks, developer depletion, and background fouling.

Another running test in which a monochrome image chart having an image area ratio of 100% is continuously formed on 10,000 sheets of paper is performed. After the running test, the produced image is evaluated in terms of image density unevenness in both solid and halftone images, ear marks, developer depletion, and background fouling.

Both solid and halftone images are produced after the running test and visually observed to evaluate the degree of image density unevenness. The degree of image density unevenness is graded into the following five levels.

A: Image density unevenness is not observed.

B: Slight image density unevenness is observed.

C: Image density unevenness is observed.

D: Considerable image density unevenness is observed.

E: Apparent image density unevenness is observed.

The grades A, B, and C are commercially viable and the grades D and E are commercially unviable.

The solid image produced after the running test is also visually observed to determine whether undesired marks are made or not by the ears of the magnetic brush (hereinafter "ear mark"). The degree of the ear marks is graded into the following four levels.

A: No ear mark is observed.

B: Ear marks are slightly observed.

C: Ear marks are considerably observed.

D: Ear marks are apparently observed.

The grades A and B are commercially viable and the grades C and D are commercially unviable.

During the running test, the produced images at every 100 sheets are visually observed to determine whether the image density at a portion corresponding to the front side of the developing device is decreased or not. The degree of developer depletion is evaluated in terms of the image density and graded into the following four levels.

A: No image has a decreased image density.

B: Two or less images have a slightly decreased image density.

C: Two or less images have a considerably decreased image density.

D: Two or more images have a considerably decreased image density.

The grades A and B are commercially viable and the grades C and D are commercially unviable.

The degree of background fouling is determined by quantifying toner particles present on the photoreceptor during development of a white solid image. Specifically, the development procedure of a white solid image is interrupted and toner particles present on the photoreceptor are transferred onto a tape. The tape having the toner particles is subjected to a measurement of image density by a 938 spectrodensitometer (from X-Rite). The image density difference (ΔID) between the blank tape and the tape having the toner particles is graded into the following four levels. The smaller the ΔID, the better the degree of background fouling.

A: ΔID is less than 0.005.

B: ΔID is not less than 0.005 and less than 0.01.

C: ΔID is not less than 0.01 and less than 0.02.

D: ΔID is 0.02 or more.

The grades A and B are commercially viable and the grades C and D are commercially unviable.

The evaluation results are shown in Table 2.

Example 2

The procedure for preparing the carrier 1 in Example 1 is repeated except for replacing the Mn ferrite particles having an average particle diameter of 35 μm with Mn—Mg ferrite particles having an average particle diameter of 35 μm. Thus, a carrier 2 having a D/h of 0.8, a surface roughness Ra of 0.55 μm, and a magnetization of 58 emu/g is prepared. Further, 7 parts of the toner 1 and 93 parts of the carrier 2 are mixed to prepare a developer 2. The developer 2 has a bulk density of 1.70 g/cm$^3$.

Example 3

The procedure for preparing the carrier 1 in Example 1 is repeated except for replacing the Mn ferrite particles having an average particle diameter of 35 μm with magnetite particles having an average particle diameter of 35 μm. Thus, a carrier 3 having a D/h of 0.8, a surface roughness Ra of 0.46 μm, and a magnetization of 70 emu/g is prepared. Further, 7 parts of the toner 1 and 93 parts of the carrier 3 are mixed to prepare a developer 3. The developer 3 has a bulk density of 1.76 g/cm$^3$.

Example 4

A covering layer liquid is prepared by dispersing 38.4 parts of an acrylic resin solution (HITALOID 3001 from Hitachi Chemical Co., Ltd.) having a solid content of 50%, 10.9 parts of a guanamine solution (MYCOAT 106 from MT AquaPolymer, Inc.) having a solid content of 70%, 0.21 parts of an acidic catalyst (CATALYST 4040 from MT AquaPolymer, Inc.) having a solid content of 40%, 486 parts of a silicone resin solution (SR2410 from Dow Corning Toray Co., Ltd.) having a solid content of 20%, 2.4 parts of an aminosilane (SH6020 from Dow Corning Toray Co., Ltd.) having a solid content of 100%, 124 parts of conductive fine particles (EC-500 from Titan Kogyo, Ltd.) having an average particle diameter of 0.43 μm and an absolute specific gravity of 4.6, and 650 parts of toluene, for 10 minutes using a HOMOMIXER.

The procedure for preparing the carrier 1 in Example 1 is repeated except for replacing the covering layer liquid with that prepared above and the Mn ferrite particles having an average particle diameter of 35 μm with Mn—Mg ferrite particles having an average particle diameter of 35 μm. Thus, a carrier 4 having a D/h of 1.1, a surface roughness Ra of 0.89 μm, and a magnetization of 59 emu/g is prepared. Further, 7 parts of the toner 1 and 93 parts of the carrier 4 are mixed to prepare a developer 4. The developer 4 has a bulk density of 1.71 g/cm$^3$.

Example 5

A covering layer liquid is prepared by dispersing 73.5 parts of an acrylic resin solution (HITALOID 3001 from Hitachi Chemical Co., Ltd.) having a solid content of 50%, 20.9 parts of a guanamine solution (MYCOAT 106 from MT AquaPolymer, Inc.) having a solid content of 70%, 0.41 parts of an acidic catalyst (CATALYST 4040 from MT AquaPolymer, Inc.) having a solid content of 40%, 929 parts of a silicone resin solution (SR2410 from Dow Corning Toray Co., Ltd.) having a solid content of 20%, 4.5 parts of an aminosilane (SH6020 from Dow Corning Toray Co., Ltd.) having a solid content of 100%, 237 parts of conductive fine particles (EC-500 from Titan Kogyo, Ltd.) having an average particle diameter of 0.43 μm and an absolute specific gravity of 4.6, and 2,600 parts of toluene, for 10 minutes using a HOMOMIXER.

The procedure for preparing the carrier 1 in Example 1 is repeated except for replacing the covering layer liquid with that prepared above and the Mn ferrite particles having an average particle diameter of 35 μm with magnetite particles having an average particle diameter of 35 μm. Thus, a carrier 5 having a D/h of 0.5, a surface roughness Ra of 0.38 μm, and a magnetization of 68 emu/g is prepared. Further, 7 parts of the toner 1 and 93 parts of the carrier 5 are mixed to prepare a developer 5. The developer 5 has a bulk density of 1.75 g/cm$^3$.

Example 6

A covering layer liquid is prepared by dispersing 38.4 parts of an acrylic resin solution (HITALOID 3001 from Hitachi Chemical Co., Ltd.) having a solid content of 50%, 10.9 parts of a guanamine solution (MYCOAT 106 from MT AquaPolymer, Inc.) having a solid content of 70%, 0.21 parts of an acidic catalyst (CATALYST 4040 from MT AquaPolymer, Inc.) having a solid content of 40%, 486 parts of a silicone resin solution (SR2410 from Dow Corning Toray Co., Ltd.) having a solid content of 20%, 2.4 parts of an aminosilane (SH6020 from Dow Corning Toray Co., Ltd.) having a solid content of 100%, 124 parts of conductive fine particles (EC-500 from Titan Kogyo, Ltd.) having an average particle diameter of 0.43 μm and an absolute specific gravity of 4.6, and 100 parts of toluene, for 10 minutes using a HOMOMIXER.

The procedure for preparing the carrier 1 in Example 1 is repeated except for replacing the covering layer liquid with that prepared above and the Mn ferrite particles having an average particle diameter of 35 μm with Mn—Mg ferrite particles having an average particle diameter of 35 μm. Thus, a carrier 6 having a D/h of 1.1, a surface roughness Ra of 0.92 μm, and a magnetization of 58 emu/g is prepared. Further, 7 parts of the toner 1 and 93 parts of the carrier 6 are mixed to prepare a developer 6. The developer 6 has a bulk density of 1.69 g/cm$^3$.

Example 7

A covering layer liquid is prepared by dispersing 82.9 parts of an acrylic resin solution (HITALOID 3001 from Hitachi Chemical Co., Ltd.) having a solid content of 50%, 23.5 parts of a guanamine solution (MYCOAT 106 from MT AquaPolymer, Inc.) having a solid content of 70%, 0.46 parts of an acidic catalyst (CATALYST 4040 from MT AquaPolymer, Inc.) having a solid content of 40%, 1,048 parts of a silicone resin solution (SR2410 from Dow Corning Toray Co., Ltd.) having a solid content of 20%, 5.1 parts of an aminosilane (SH6020 from Dow Corning Toray Co., Ltd.) having a solid content of 100%, 268 parts of conductive fine particles (EC-500 from Titan Kogyo, Ltd.) having an average particle diameter of 0.43 μm and an absolute specific gravity of 4.6, and 2,910 parts of toluene, for 10 minutes using a HOMOMIXER.

The procedure for preparing the carrier 1 in Example 1 is repeated except for replacing the covering layer liquid with that prepared above and the Mn ferrite particles having an average particle diameter of 35 μm with magnetite particles having an average particle diameter of 35 μm. Thus, a carrier 7 having a D/h of 0.4, a surface roughness Ra of 0.36 μm, and a magnetization of 67 emu/g is prepared. Further, 7 parts of the toner 1 and 93 parts of the carrier 7 are mixed to prepare a developer 7. The developer 7 has a bulk density of 1.75 g/cm$^3$.

Example 8

The procedure for preparing the toner 1 in Example 1 is repeated except for replacing 5 parts of the paraffin wax with 2 parts of the paraffin wax. Thus, a toner 2 is prepared. Further, 7 parts of the toner 2 and 93 parts of the carrier 1 are mixed to prepare a developer 8. The developer 8 has a bulk density of 1.85 g/cm$^3$.

Example 9

The procedure for preparing the toner 1 in Example 1 is repeated except for replacing 5 parts of the paraffin wax with 7 parts of the paraffin wax. Thus, a toner 3 is prepared. Further, 7 parts of the toner 3 and 93 parts of the carrier 1 are mixed to prepare a developer 9. The developer 9 has a bulk density of 1.70 g/cm$^3$.

Example 10

The procedure for preparing the toner 1 in Example 1 is repeated except for replacing 5 parts of the paraffin wax with 1.5 parts of the paraffin wax. Thus, a toner 4 is prepared. Further, 7 parts of the toner 4 and 93 parts of the carrier 1 are mixed to prepare a developer 10. The developer 10 has a bulk density of 1.87 g/cm$^3$.

Example 11

The procedure for preparing the toner 1 in Example 1 is repeated except for replacing 5 parts of the paraffin wax with 8 parts of the paraffin wax. Thus, a toner 5 is prepared. Further, 7 parts of the toner 5 and 93 parts of the carrier 1 are mixed to prepare a developer 11. The developer 11 has a bulk density of 1.68 g/cm$^3$.

Example 12

A covering layer liquid is prepared by dispersing 799 parts of a silicone resin solution (SR2410 from Dow Corning Toray Co., Ltd.) having a solid content of 20%, 3.2 parts of an aminosilane (SH6020 from Dow Corning Toray Co., Ltd.) having a solid content of 100%, 65 parts of conductive fine particles (EC-500 from Titan Kogyo, Ltd.) having an average particle diameter of 0.43 μm and an absolute specific gravity of 4.6, and 1,800 parts of toluene, for 10 minutes using a HOMOMIXER.

The procedure for preparing the carrier 1 in Example 1 is repeated except for replacing the covering layer liquid with that prepared above. Thus, a carrier 8 having a D/h of 0.8, a surface roughness Ra of 0.39 μm, and a magnetization of 65 emu/g is prepared. Further, 7 parts of the toner 1 and 93 parts of the carrier 8 are mixed to prepare a developer 12. The developer 12 has a bulk density of 1.75 g/cm$^3$.

Example 13

A covering layer liquid is prepared by dispersing 45.3 parts of an acrylic resin solution (HITALOID 3001 from Hitachi Chemical Co., Ltd.) having a solid content of 50%, 12.9 parts of a guanamine solution (MYCOAT 106 from MT AquaPolymer, Inc.) having a solid content of 70%, 0.25 parts of an acidic catalyst (CATALYST 4040 from MT AquaPolymer, Inc.) having a solid content of 40%, 572 parts of a silicone resin solution (SR2410 from Dow Corning Toray Co., Ltd.) having a solid content of 20%, 2.8 parts of an aminosilane (SH6020 from Dow Corning Toray Co., Ltd.) having a solid content of 100%, 156 parts of conductive fine particles (EC-210 from Titan Kogyo, Ltd.) having an average particle diameter of 0.51 μm and an absolute specific gravity of 4.6, and 1,590 parts of toluene, for 10 minutes using a HOMOMIXER.

The procedure for preparing the carrier 1 in Example 1 is repeated except for replacing the covering layer liquid with that prepared above and the Mn ferrite particles having an average particle diameter of 35 μm with Mn—Mg ferrite particles having an average particle diameter of 35 μm. Thus, a carrier 9 having a D/h of 1.1, a surface roughness Ra of 0.90 μm, and a magnetization of 60 emu/g is prepared. Further, 7 parts of the toner 1 and 93 parts of the carrier 9 are mixed to prepare a developer 13. The developer 13 has a bulk density of 1.74 g/cm$^3$.

Example 14

A covering layer liquid is prepared by dispersing 51.3 parts of an acrylic resin solution (HITALOID 3001 from Hitachi Chemical Co., Ltd.) having a solid content of 50%, 14.6 parts of a guanamine solution (MYCOAT 106 from MT AquaPolymer, Inc.) having a solid content of 70%, 0.29 parts of an acidic catalyst (CATALYST 4040 from MT AquaPolymer, Inc.) having a solid content of 40%, 648 parts of a silicone resin solution (SR2410 from Dow Corning Toray Co., Ltd.) having a solid content of 20%, 3.2 parts of an aminosilane (SH6020 from Dow Corning Toray Co., Ltd.) having a solid content of 100%, 148 parts of conductive fine particles (EC-300E from Titan Kogyo, Ltd.) having an average particle diameter of 0.27 μm and an absolute specific gravity of 5.0, and 1,800 parts of toluene, for 10 minutes using a HOMOMIXER.

The procedure for preparing the carrier 1 in Example 1 is repeated except for replacing the covering layer liquid with that prepared above and the Mn ferrite particles having an average particle diameter of 35 μm with magnetite particles having an average particle diameter of 35 μm. Thus, a carrier 10 having a D/h of 0.5, a surface roughness Ra of 0.39 μm, and a magnetization of 69 emu/g is prepared. Further, 7 parts of the toner 1 and 93 parts of the carrier 10 are mixed to prepare a developer 14. The developer 14 has a bulk density of 1.78 g/cm$^3$.

Example 15

A covering layer liquid is prepared by dispersing 41.0 parts of an acrylic resin solution (HITALOID 3001 from Hitachi Chemical Co., Ltd.) having a solid content of 50%, 11.6 parts of a guanamine solution (MYCOAT 106 from MT AquaPolymer, Inc.) having a solid content of 70%, 0.23 parts of an acidic catalyst (CATALYST 4040 from MT AquaPolymer, Inc.) having a solid content of 40%, 518 parts of a silicone resin solution (SR2410 from Dow Corning Toray Co., Ltd.) having a solid content of 20%, 2.5 parts of an aminosilane (SH6020 from Dow Corning Toray Co., Ltd.) having a solid content of 100%, 139 parts of conductive fine particles (EC-210 from Titan Kogyo, Ltd.) having an average particle diameter of 0.51 μm and an absolute specific gravity of 4.6, and 1,440 parts of toluene, for 10 minutes using a HOMOMIXER.

The procedure for preparing the carrier 1 in Example 1 is repeated except for replacing the covering layer liquid with that prepared above and the Mn ferrite particles having an average particle diameter of 35 μm with Mn—Mg ferrite particles having an average particle diameter of 35 μm. Thus, a carrier 11 having a D/h of 1.2, a surface roughness Ra of 0.94 μm, and a magnetization of 60 emu/g is prepared. Further, 7 parts of the toner 1 and 93 parts of the carrier 11 are mixed to prepare a developer 15. The developer 15 has a bulk density of 1.75 g/cm$^3$.

Example 16

A covering layer liquid is prepared by dispersing 51.3 parts of an acrylic resin solution (HITALOID 3001 from Hitachi Chemical Co., Ltd.) having a solid content of 50%, 14.6 parts of a guanamine solution (MYCOAT 106 from MT AquaPolymer, Inc.) having a solid content of 70%, 0.29 parts of an acidic catalyst (CATALYST 4040 from MT AquaPolymer, Inc.) having a solid content of 40%, 648 parts of a silicone resin solution (SR2410 from Dow Corning Toray Co., Ltd.) having a solid content of 20%, 3.2 parts of an aminosilane (SH6020 from Dow Corning Toray Co., Ltd.) having a solid content of 100%, 136 parts of conductive fine particles (PASSTRAN® 4310 from Mitsui Mining & Smelting Co., Ltd.) having an average particle diameter of 0.20 μm and an absolute specific gravity of 5.6, and 1,800 parts of toluene, for 10 minutes using a HOMOMIXER.

The procedure for preparing the carrier 1 in Example 1 is repeated except for replacing the covering layer liquid with that prepared above and the Mn ferrite particles having an average particle diameter of 35 μm with magnetite particles having an average particle diameter of 35 μm. Thus, a carrier 12 having a D/h of 0.4, a surface roughness Ra of 0.32 μm, and a magnetization of 69 emu/g is prepared. Further, 7 parts of the toner 1 and 93 parts of the carrier 12 are mixed to prepare a developer 16. The developer 16 has a bulk density of 1.80 g/cm$^3$.

Example 17

Seven parts of the toner 5 prepared in Example 11 and 93 parts of the carrier 6 prepared in Example 6 are mixed to prepare a developer 17. The developer 17 has a bulk density of 1.65 g/cm$^3$.

Example 18

Seven parts of the toner 4 prepared in Example 10 and 93 parts of the carrier 7 prepared in Example 7 are mixed to prepare a developer 18. The developer 18 has a bulk density of 1.89 g/cm$^3$.

Example 19

Seven parts of the toner 4 prepared in Example 10 and 93 parts of the carrier 11 prepared in Example 15 are mixed to prepare a developer 19. The developer 19 has a bulk density of 1.88 g/cm$^3$.

Example 20

Seven parts of the toner 5 prepared in Example 11 and 93 parts of the carrier 12 prepared in Example 16 are mixed to prepare a developer 20. The developer 20 has a bulk density of 1.68 g/cm$^3$.

Comparative Example 1

The procedure for preparing the carrier 1 in Example 1 is repeated except for replacing the Mn ferrite particles having an average particle diameter of 35 μm with Mn—Mg ferrite particles having an average particle diameter of 35 μm, the oxidization treatment time of which is twice as long as that of the Mn ferrite particles. Thus, a carrier 13 having a D/h of 0.8, a surface roughness Ra of 0.53 and a magnetization of 56 emu/g is prepared. Further, 7 parts of the toner 1 and 93 parts of the carrier 13 are mixed to prepare a developer 21. The developer 21 has a bulk density of 1.69 g/cm$^3$.

Comparative Example 2

The procedure for preparing the carrier 1 in Example 1 is repeated except for replacing the Mn ferrite particles having an average particle diameter of 35 μm with magnetite particles having an average particle diameter of 35 μm without oxidization treatment. Thus, a carrier 14 having a D/h of 0.8, a surface roughness Ra of 0.44 and a magnetization of 71 emu/g is prepared. Further, 7 parts of the toner 1 and 93 parts of the carrier 14 are mixed to prepare a developer 22. The developer 22 has a bulk density of 1.78 g/cm$^3$.

Comparative Example 3

Figure 8:
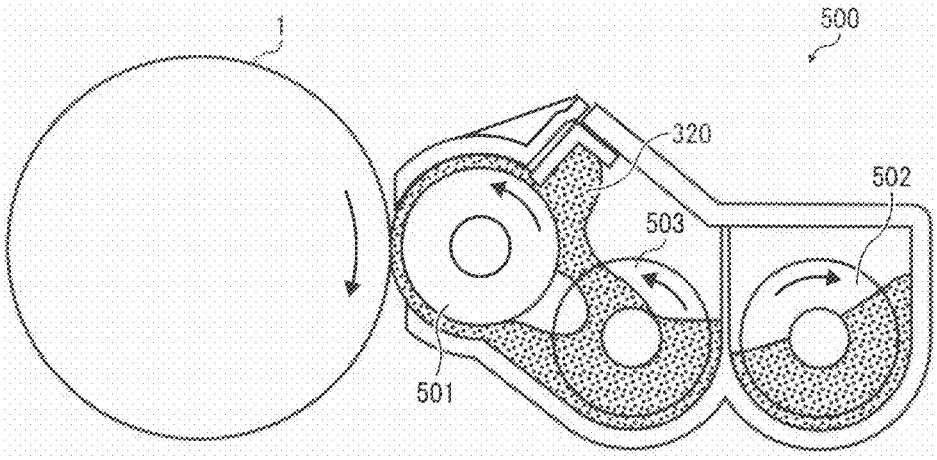
FIG. 8 RELATED ART
FIG. 8 is a schematic view illustrating a related art developing device.

The procedure in Example 1 is repeated except for replacing the developing device illustrated in FIG. 1 with that illustrated in FIG. 8.

TABLE 1

| | Developer No. | Carrier No. | Toner No. | Saturated Magnetization (1KOe) (emu/g) | Surface Roughness Ra (μm) | D/h | Binder Resins | Weight Average Particle Diameter (μm) | Covering Layer Thickness (μm) | Bulk Density of Developer (g/cm3) |
|---|---|---|---|---|---|---|---|---|---|---|
| Example 1 | 1 | 1 | 1 | 64 | 0.51 | 0.8 | Acrylic/ Silicone | 37 | 0.55 | 1.73 |
| Example 2 | 2 | 2 | 1 | 58 | 0.55 | 0.8 | Acrylic/ Silicone | 36 | 0.54 | 1.70 |

TABLE 1-continued

| | Developer No. | Carrier No. | Toner No. | Saturated Magnetization (1KOe) (emu/g) | Surface Roughness Ra (μm) | D/h | Binder Resins | Weight Average Particle Diameter (μm) | Covering Layer Thickness (μm) | Bulk Density of Developer (g/cm3) |
|---|---|---|---|---|---|---|---|---|---|---|
| Example 3 | 3 | 3 | 1 | 70 | 0.46 | 0.8 | Acrylic/ Silicone | 37 | 0.55 | 1.76 |
| Example 4 | 4 | 4 | 1 | 59 | 0.89 | 1.1 | Acrylic/ Silicone | 36 | 0.38 | 1.71 |
| Example 5 | 5 | 5 | 1 | 68 | 0.38 | 0.5 | Acrylic/ Silicone | 37 | 0.85 | 1.75 |
| Example 6 | 6 | 6 | 1 | 58 | 0.92 | 1.1 | Acrylic/ Silicone | 36 | 0.38 | 1.69 |
| Example 7 | 7 | 7 | 1 | 67 | 0.36 | 0.4 | Acrylic/ Silicone | 37 | 0.98 | 1.75 |
| Example 8 | 8 | 1 | 2 | 64 | 0.51 | 0.8 | Acrylic/ Silicone | 37 | 0.55 | 1.85 |
| Example 9 | 9 | 1 | 3 | 64 | 0.51 | 0.8 | Acrylic/ Silicone | 37 | 0.55 | 1.70 |
| Example 10 | 10 | 1 | 4 | 64 | 0.51 | 0.8 | Acrylic/ Silicone | 37 | 0.55 | 1.87 |
| Example 11 | 11 | 1 | 5 | 64 | 0.51 | 0.8 | Acrylic/ Silicone | 37 | 0.55 | 1.68 |
| Example 12 | 12 | 8 | 1 | 65 | 0.39 | 0.8 | Silicone | 37 | 0.56 | 1.75 |
| Example 13 | 13 | 9 | 1 | 60 | 0.90 | 1.1 | Acrylic/ Silicone | 37 | 0.47 | 1.74 |
| Example 14 | 14 | 10 | 1 | 69 | 0.39 | 0.5 | Acrylic/ Silicone | 36 | 0.55 | 1.78 |
| Example 15 | 15 | 11 | 1 | 60 | 0.94 | 1.2 | Acrylic/ Silicone | 36 | 0.43 | 1.75 |
| Example 16 | 16 | 12 | 1 | 69 | 0.32 | 0.4 | Acrylic/ Silicone | 36 | 0.55 | 1.80 |
| Example 17 | 17 | 6 | 5 | 58 | 0.92 | 1.1 | Acrylic/ Silicone | 36 | 0.38 | 1.65 |
| Example 18 | 18 | 7 | 4 | 67 | 0.36 | 0.4 | Acrylic/ Silicone | 37 | 0.98 | 1.89 |
| Example 19 | 19 | 11 | 4 | 60 | 0.94 | 1.2 | Acrylic/ Silicone | 36 | 0.43 | 1.88 |
| Example 20 | 20 | 12 | 5 | 69 | 0.32 | 0.4 | Acrylic/ Silicone | 36 | 0.55 | 1.68 |
| Comparative Example 1 | 21 | 13 | 1 | 56 | 0.53 | 0.8 | Acrylic/ Silicone | 37 | 0.55 | 1.69 |
| Comparative Example 2 | 22 | 14 | 1 | 71 | 0.44 | 0.8 | Acrylic/ Silicone | 37 | 0.55 | 1.78 |
| Comparative Example 3 | 1 | 1 | 1 | 64 | 0.51 | 0.8 | Acrylic/ Silicone | 37 | 0.55 | 1.73 |

TABLE 2

| | Running Test (Image ratio: 20%) | | | | | Running Test (Image ratio: 100%) | | | | |
|---|---|---|---|---|---|---|---|---|---|---|
| | Image Density Unevenness | | | | | Image Density Unevenness | | | | |
| | Solid Image | Halftone Image | Ear Marks | Developer Depletion | Background Fouling | Solid Image | Halftone Image | Ear Marks | Developer Depletion | Background Fouling |
| Example 1 | A | A | A | A | A | A | B | A | A | A |
| Example 2 | A | B | A | A | A | B | B | A | A | A |
| Example 3 | A | A | B | A | A | A | B | B | A | A |
| Example 4 | B | B | A | A | A | C | C | A | A | B |
| Example 5 | A | B | B | B | A | A | B | C | B | B |
| Example 6 | C | C | A | A | B | C | C | A | A | B |
| Example 7 | A | A | C | B | B | B | B | C | B | B |
| Example 8 | A | A | A | B | A | A | B | A | B | B |
| Example 9 | A | B | A | A | A | B | B | A | A | A |
| Example 10 | A | A | A | B | B | A | B | A | C | B |
| Example 11 | B | B | A | A | A | B | C | A | A | A |
| Example 12 | A | A | B | A | A | B | A | B | A | B |
| Example 13 | B | B | A | A | A | C | C | A | A | A |
| Example 14 | A | B | B | A | A | A | B | C | B | A |
| Example 15 | C | C | A | A | B | C | C | A | A | C |
| Example 16 | A | A | C | B | B | B | B | C | B | C |
| Example 17 | C | C | A | A | B | C | C | A | A | C |
| Example 18 | A | A | B | B | B | B | B | C | C | B |
| Example 19 | B | B | A | B | B | B | C | A | C | C |

TABLE 2-continued

| | Running Test (Image ratio: 20%) | | | | | Running Test (Image ratio: 100%) | | | | |
|---|---|---|---|---|---|---|---|---|---|---|
| | Image Density Unevenness | | | | | Image Density Unevenness | | | | |
| | Solid Image | Halftone Image | Ear Marks | Developer Depletion | Background Fouling | Solid Image | Halftone Image | Ear Marks | Developer Depletion | Background Fouling |
| Example 20 | A | B | B | A | B | B | C | C | B | B |
| Comparative Example 1 | D | D | A | A | B | D | D | A | A | B |
| Comparative Example 2 | A | B | D | A | C | B | B | D | A | C |
| Comparative Example 3 | C | C | A | A | D | D | C | A | A | D |

Additional modifications and variations of the present invention are possible in light of the above teachings. It is therefore to be understood that within the scope of the appended claims the invention may be practiced other than as specifically described herein.

What is claimed is:

1. A developing device, comprising:

a cylindrical and rotatable developer bearing member comprising a magnetic field generator having multiple magnetic poles, the developer bearing member being disposed facing an electrostatic latent image bearing member to form a developing area therebetween; and a developer chamber comprising a two-component developer comprising magnetic carrier particles having a saturated magnetization of 58 to 70 emu/g in a magnetic field of 1KOe and toner particles, the developer comprising chamber having a divider to define an upper supply chamber and a lower collection chamber, the supply chamber disposed on a substantially upper side of the developer bearing member, the supply chamber comprising a supply conveyer to supply the two-component developer to the developer bearing member at an upstream side from the developing area while conveying the two-component developer in an axial direction of the developer bearing member within the supply chamber, the collection chamber disposed on a substantially lower side of the developer bearing member, the collection chamber comprising a collection conveyer to collect the two-component developer from the developer bearing member at a downstream side from the developing area while conveying the two-component developer in the axial direction of the developer bearing member within the collection chamber, wherein the multiple magnetic poles includes three developer bearing poles capable of bearing the developer on its surface, the three developer bearing poles consisting of a developing pole, a pre-developing pole, and a post-developing pole, the developing pole generating a magnetic field in the developing area, the pre-developing pole generating a magnetic field that conveys the developer supplied from the supply chamber to the developing area, the post-developing pole generating a magnetic field that separates the developer from the developer bearing member at a downstream side from the developing area and an upstream side from the developing pole, and the magnetic carrier particles have a surface roughness Ra of 0.38 to 0.90 μm.

2. The developing device according to claim 1, wherein the two-component developer has a bulk density of 1.69 to 1.85 g/cm$^3$.

3. The developing device according to claim 1, wherein the magnetic carrier particles have a weight average particle diameter of 25 to 45 μm.

4. The developing device according to claim 1, wherein each of the magnetic carrier particles has a covering layer comprising an acrylic resin and a silicone resin.

5. The developing device according to claim 4, wherein the covering layer further comprising conductive fine particles and satisfying the following formula:

$$0.5 \leq D/h \leq 1.1$$

wherein D represents an average particle diameter of the conductive fine particles and h represents a thickness of the covering layer.

6. The developing device according to claim 4, wherein the covering layer has an average thickness of 0.05 to 4 μm.

7. An image forming apparatus, comprising:

an electrostatic latent image bearing member to bear an electrostatic latent image;

the developing device according to claim 1 to develop the electrostatic latent image into a toner image with the two-component developer;

a transfer device to transfer the toner image from the electrostatic latent image bearing member onto a recording medium; and a fixing device to fix the toner image on the recording medium.

8. A process cartridge detachably attachable to image forming apparatus, comprising:

an electrostatic latent image bearing member to bear an electrostatic latent image; and the developing device according to claim 1 to develop the electrostatic latent image into a toner image with the two-component developer.

9. The developing device according to claim 1, wherein said magnetic carrier particles comprise at least one core material selected from the group consisting of ferrite, Cu—Zn ferrite, Mn ferrite, Mn—Mg ferrite, Mn—Mg—Sr ferrite, magnetite, iron, and nickel.

10. The developing device according to claim 1, wherein said magnetic carrier particles comprise a core material of ferrite.

11. The developing device according to claim 1, wherein said magnetic carrier particles comprise a core material of Cu—Zn ferrite.

12. The developing device according to claim 1, wherein said magnetic carrier particles comprise a core material of Mn ferrite.

13. The developing device according to claim 1, wherein said magnetic carrier particles comprise a core material of Mn—Mg ferrite.

14. The developing device according to claim 1, wherein said magnetic carrier particles comprise a core material of Mn—Mg—Sr ferrite.

15. The developing device according to claim 1, wherein said magnetic carrier particles comprise a core material of magnetite.

16. The developing device according to claim 1, wherein said magnetic carrier particles comprise a core material of iron.

17. The developing device according to claim 1, wherein said magnetic carrier particles comprise a core material of nickel.

* * * * *